US011661233B2

(12) United States Patent
Vinger

(10) Patent No.: US 11,661,233 B2
(45) Date of Patent: May 30, 2023

(54) RECLOSABLE CAN ENDS

(71) Applicant: Florence M Vinger, Los Angeles, CA (US)

(72) Inventor: Florence M Vinger, Los Angeles, CA (US)

( * ) Notice: Subject to any disclaimer, the term of this patent is extended or adjusted under 35 U.S.C. 154(b) by 363 days.

(21) Appl. No.: 16/853,237

(22) Filed: Apr. 20, 2020

(65) Prior Publication Data

US 2020/0407109 A1 Dec. 31, 2020

Related U.S. Application Data

(60) Provisional application No. 62/868,709, filed on Jun. 28, 2019.

(51) Int. Cl.

| | |
|---|---|
| ***B65D 17/28*** | (2006.01) |
| ***B65D 17/34*** | (2006.01) |
| ***B65D 41/32*** | (2006.01) |

(52) U.S. Cl.

CPC ..... *B65D 17/4014* (2018.01); *B65D 17/34* (2018.01); *B65D 2251/20* (2013.01); *B65D 2517/0034* (2013.01); *B65D 2517/0044* (2013.01)

(58) Field of Classification Search

CPC ..... B65D 17/4014; B65D 17/34; B65D 2251/20; B65D 2517/0044; B65D 2517/0011; B65D 2517/0034; B65D 2517/0014; B65D 2517/0025; B65D 2517/0043; Y10S 220/906

USPC ..... 220/269, 906, 821, 270, 254.4

See application file for complete search history.

(56) References Cited

U.S. PATENT DOCUMENTS

| | | | | |
|---|---|---|---|---|
| 4,210,257 A * | 7/1980 | Radtke | B65D 17/4012 | 220/269 |
| 4,211,335 A * | 7/1980 | Langseder | B65D 17/4012 | 220/269 |
| 4,219,127 A * | 8/1980 | Bielicki | B65D 17/4012 | 220/269 |
| 4,433,792 A * | 2/1984 | Mandel | B65D 17/4014 | 220/269 |
| 4,442,950 A * | 4/1984 | Wilson | B65D 17/4014 | 220/269 |

(Continued)

OTHER PUBLICATIONS

International Preliminary Report on Patentability dated Jan. 6, 2022 in International Patent Application No. PCT/US2020/038680, pp. 1-10.

(Continued)

*Primary Examiner* — Gideon R Weinerth

(74) *Attorney, Agent, or Firm* — Byrne Poh LLP

(57) ABSTRACT

A reclosable can end is provided. In some embodiments, the reclosable can end comprises: a lid base that comprises a scored area; a tab that causes the scored area to at least partially separate from the lid base to expose an opening in the lid base; a closure flap, wherein the closure flap comprises: a first portion; a second portion; an opening; and a protruding portion; and a rivet that connects the tab and the closure flap to the lid base such that the tab and the closure flap are configured to rotate around the rivet, wherein the first portion of the closure flap is configured to be inserted into the opening in the lid base end when the tab and the closure flap are rotated to a position corresponding to a position of the opening in the lid base.

20 Claims, 16 Drawing Sheets

(56) References Cited

U.S. PATENT DOCUMENTS 4,463,866 A * 8/1984 Mandel ..... B65D 17/4014 220/269
4,596,342 A * 6/1986 Zysset ..... B65D 17/28 220/273
4,681,238 A * 7/1987 Sanchez ..... B65D 17/4014 220/270
4,717,039 A * 1/1988 Ayyoubi ..... B65D 47/265 220/253
4,720,022 A * 1/1988 Gomes ..... B65D 17/4014 220/269
4,877,129 A * 10/1989 Wells ..... B65D 17/4014 220/269
4,880,136 A * 11/1989 Englert ..... B65D 17/4012 220/253
4,880,137 A * 11/1989 Wells ..... B65D 17/4014 220/269
4,887,712 A * 12/1989 Wells ..... B65D 17/4014 206/269
4,951,835 A * 8/1990 DeMars ..... B65D 17/4014 220/269
4,979,635 A * 12/1990 Levine ..... B65D 17/4014 220/269
5,011,037 A * 4/1991 Moen ..... B65D 17/4012 220/269
5,224,618 A * 7/1993 Garbiso ..... B65D 17/4012 220/269
5,975,327 A * 11/1999 Funk ..... B65D 17/4014 220/269
6,059,137 A * 5/2000 Westwood ..... B65D 17/4014 220/269
6,158,608 A * 12/2000 Schlattl ..... C23D 5/02 220/253
6,450,359 B1 * 9/2002 Chang ..... B65D 17/4012 220/268
6,588,617 B1 * 7/2003 Majcen ..... B65D 17/4014 220/258.2
6,763,963 B1 * 7/2004 Martin ..... B65D 17/4014 220/254.1
6,793,087 B2 * 9/2004 Dyren ..... B65D 17/4014 220/730
7,198,168 B2 * 4/2007 Mizuma ..... B65D 17/4014 220/730
8,651,318 B2 * 2/2014 Brandtner ..... B65D 17/4014 220/269
8,678,221 B2 * 3/2014 Thiemann ..... B65D 17/4012 220/906
9,233,784 B2 * 1/2016 Jacober ..... B65D 17/4012
9,714,115 B2 * 7/2017 Chasteen ..... B65D 17/4012
D803,052 S * 11/2017 Senter ..... D9/438
9,938,051 B2 * 4/2018 Harris ..... B65D 43/18
10,017,295 B2 * 7/2018 Chasteen ..... B65D 47/32
10,632,520 B2 * 4/2020 Rayburn ..... B65D 17/4012
10,815,027 B2 * 10/2020 Gatewood ..... B65D 17/4012
2002/0108954 A1 * 8/2002 Cho ..... B65D 17/4012 220/269
2004/0094550 A1 * 5/2004 Poole ..... B65D 17/4012 220/730
2004/0256388 A1 * 12/2004 Rossetti ..... B65D 17/4014 220/730
2005/0051553 A1 3/2005 Li et al.
2005/0236411 A1 * 10/2005 Huffman ..... B65D 17/4014 220/254.4
2006/0163254 A1 * 7/2006 Wichelhaus ..... B65D 17/4014 220/619
2007/0062946 A1 * 3/2007 Huffman ..... B65D 17/4014 220/269
2007/0138178 A1 * 6/2007 Erickson ..... B65D 17/4014 220/269
2011/0163096 A1 7/2011 Wichelhaus
2011/0240645 A1 * 10/2011 Schley ..... B65D 17/4014 220/269
2012/0285962 A1 * 11/2012 Seo ..... B65D 17/4014 220/259.3
2015/0329238 A1 * 11/2015 Chasteen ..... B65D 47/32 220/269
2016/0023802 A1 * 1/2016 Brandtner ..... B65D 17/4014 220/258.5
2017/0107010 A1 4/2017 Keane et al.
2018/0141702 A1 * 5/2018 Afshin ..... B65D 17/4014
2018/0170632 A1 * 6/2018 da Silva ..... B65D 51/222
2019/0283930 A1 * 9/2019 Schuver ..... B65D 17/4014
2020/0307856 A1 * 10/2020 Pawezka ..... B65D 17/4014
2021/0300623 A1 * 9/2021 Bratsch ..... B65D 17/4014
2022/0127040 A1 * 4/2022 Wang ..... B65D 85/72
2022/0396394 A1 * 12/2022 Stengel, Jr. ..... B65D 17/4014

OTHER PUBLICATIONS

International Search Report and Written Opinion dated Sep. 11, 2020 in International Patent Application No. PCT/US2020/038680, pp. 1-14.

XRE Corporation, "XRE Solution", Oct. 15, 2016, available at: https://web.archive.org/web/20161015231749/http://xre.co.kr/sub/sub_XRE_SOLUTION.php, pp. 1-5.

* cited by examiner

RECLOSABLE CAN ENDS

CROSS REFERENCE TO RELATED APPLICATIONS

This application claims the benefit of U.S. Provisional Application No. 62/868,709, filed Jun. 28, 2019, which is hereby incorporated by reference herein in its entirety.

TECHNICAL FIELD

The disclosed subject matter relates to reclosable can ends.

BACKGROUND

Cans are frequently used for storing and drinking such beverages as soda, beer, water, Ready To Drink (RTD) beverages and cocktails, energy drinks, juices, sparkling water and many more beverages and liquids, and/or for other cannable storage needs. Cans, which are often made from aluminum and aluminum alloy, are convenient for storing and drinking for many reasons. For example, aluminum is lightweight, is easily transportable, saves space in shipping containers, is sturdy, and is 100% recyclable. However, once a can is opened, it is typically not used as a portable container. In particular, cans are typically not reclosable, and it can therefore be difficult to transport an opened can and to keep a beverage in an opened can free from dirt, debris, or bugs.

Accordingly, it is desirable to provide a reclosable can end.

SUMMARY

A reclosable can end is provided.

In accordance with some embodiments, of the disclosed subject matter, a reclosable can end is provided, the reclosable can end comprising: a lid base positioned at a top portion of the reclosable can end, wherein the lid base comprises a scored area; a tab, wherein a first end of the tab is configured to apply pressure to the scored area of the lid base when a second end of the tab, opposite the first end of the tab, is lifted and causes the scored area to at least partially separate from the lid base to expose an opening in the lid base; a closure flap, wherein the closure flap comprises: a first portion that has dimensions corresponding to dimensions of the opening in the lid base opening wherein the first portion of the closure flap includes a raised bump that connects with a portion of the tab; a second portion that comprises an outer edge that extends beyond the first portion of the closure flap; an opening; and a protruding portion that protrudes from the outer edge of the second portion of the closure flap; and a rivet that connects the tab and the closure flap to the lid base such that the tab and the closure flap are configured to rotate around the rivet, wherein the rivet connects the tab and the closure flap to the lid base via the opening in the closure flap, wherein the first portion of the closure flap is configured to be inserted into the opening in the lid base end when the tab and the closure flap are rotated to a position corresponding to a position of the opening in the lid base, wherein the outer edge of the second portion of the closure flap is positioned on the top portion of the lid base when the first portion of the closure flap is inserted into the opening in the lid base, and wherein an edge that connects the first portion of the closure flap to the outer edge of the second portion of the closure flap includes an angled portion that connects to an indented portion such that the indented portion is positioned on a bottom portion of the lid base opening edge when the first portion of the closure flap is inserted into the opening of the lid base.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1A:
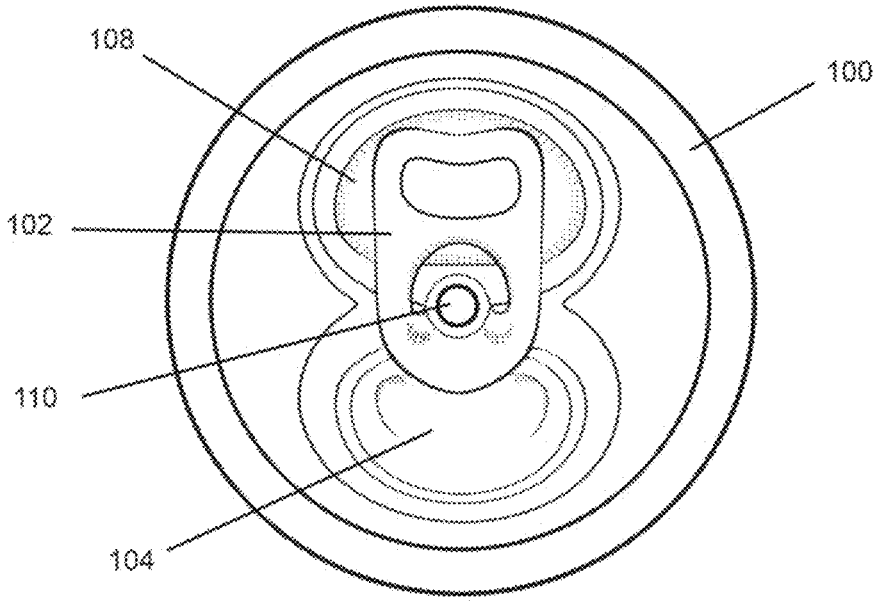
FIGS. 1A and 1B show top views of a reclosable can end with an attached lid base, tab, rivet, and closure flap in accordance with some embodiments of the disclosed subject matter.

In accordance with various embodiments, reclosable can ends are provided.

In some embodiments, reclosable can ends are described herein. In some embodiments, a reclosable can end can be part of any suitable type of can, such as a soda can, that can be used to store any suitable type of liquid or beverage, or a can that can be used for any other suitable cannable storage needs.

In some embodiments, a can that includes a reclosable can end can be opened. For example, in some embodiments, a lid base of the can end (e.g., a flat top portion of the can end) can be opened such that a scored flap of the lid base is pressed inward to expose an opening in the lid base. In some embodiments, a scored flap can be pressed inward in any suitable manner, such as by using a tab attached to the lid base that can act as a lever to apply pressure to the scored portion, thereby breaking a perforated border of the scored flap and lid base.

In some embodiments, the tab can be coupled to a closure flap that has a size and dimensions corresponding to an opening in the lid base such that the closure flap can be turned and then pressed into the opening to close the opening in the lid base, thereby providing a seal in the opening in the lid base. In some embodiments, the closure flap can be pulled and/or rotated out of the opening to open the lid base. Continuing further, in some embodiments, the closure flap can be reinserted in the lid base to reclose the opening in the lid base. In some embodiments, the closure flap can be inserted and rotated from an opening of an opened can any suitable number of times while still maintaining a seal over the opening.

In some embodiments, a tab can be coupled to a closure flap and attached to a lid base of a can end in any suitable manner. For example, in some embodiments, a tab can be coupled to a closure flap and attached to a lid base via a rivet made from a raised center area of the lid base, as shown in and described below in connection with FIGS. 10A, 10B, and 10C. As another example, in some embodiments, a tab can be coupled to a closure flap and attached to a lid base via a rivet made from a raised center area of the tab, such as shown in and described below in connection with FIG. 3E. As yet another example, in some embodiments, a tab can be coupled to a closure flap and attached to a lid base via an independent rivet, such as shown in and described below in connection with FIGS. 4A, 4B, and 4C. In some embodiments, any suitable mechanism can be used to couple a tab to a closure flap and to attach the coupled tab and closure flap to a lid base, which can allow the tab and the closure flap to lock and rotate together.

Note that, in some embodiments, "can end" can refer to a top portion of a can. In some embodiments, a can end can include any suitable elements, such as a lid base (e.g., a flat portion of a can end with shaped edges to allow the can end to attach to a can body), a scored flap corresponding to an opening in the lid base when the can has been opened, a closure flap, a tab, and/or any suitable rivets. Additionally, note that, in some embodiments, lid bases, closure flaps, tabs, and rivets as described herein can be manufactured for can ends of any suitable size.

In some embodiments, a closure flap, tab, and any rivets can remain attached to a can, thereby reducing litter and protecting consumers and animals from abrasions due to any sharp and/or metal edges. Additionally, in some embodiments, any suitable portions of a closure flap, tab, rivets, lid base, and/or any other suitable elements of a can end can be made from any suitable materials (e.g., aluminum and/or aluminum alloy as used in a can body), thereby allowing the closure flap, tab, rivets, and/or lid base to be recycled.

Figure 1B:
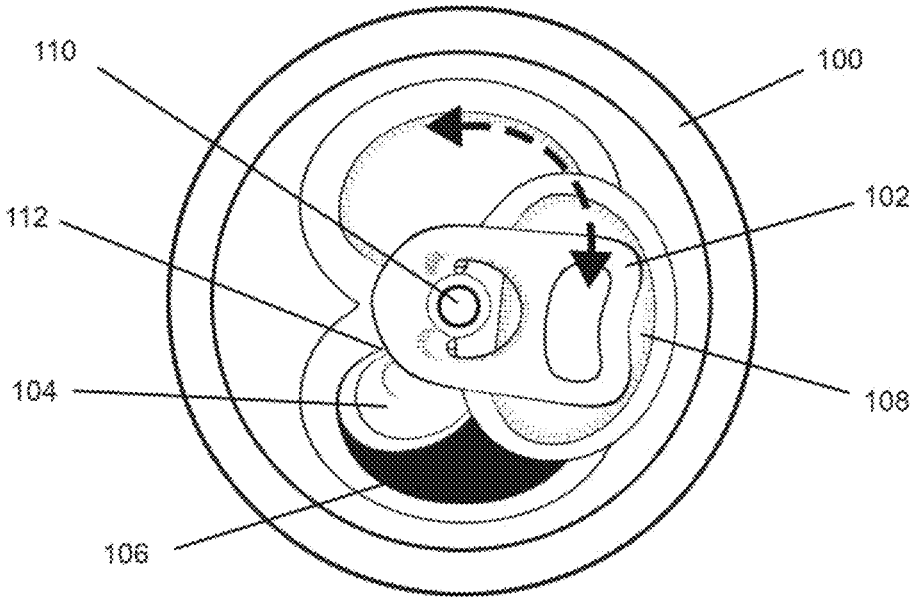

Turning to FIGS. 1A and 1B, top views of examples of reclosable can ends are shown in accordance with some embodiments of the disclosed subject matter. FIG. 1A shows an example of a lid base 100 that has not yet been opened. Note that, in some embodiments, a can end can be made of any suitable material, such as aluminum, an aluminum alloy, steel, and/or any other suitable materials. Additionally, note that, in some embodiments, a body of a can can be made of a different material than a can end. In some embodiments, an internal portion of a can end can be coated with any suitable material or combination of materials. For example, in some embodiments, an internal portion of the can end can be coated with epoxy resin. As another example, in some embodiments, an internal portion of the can end can be coated with a polymer plastic lining that is made of any suitable material or combination of materials (e.g., polyethylene, polypropylene, polyester, styrene, acrylic, vinyl, and/or any other suitable material(s)).

As illustrated, FIG. 1A includes a tab 102, a closure flap 108, a tab rivet area 110, lid base 100, and a scored flap 104. Note that, as shown in FIG. 1A, scored flap 104 is fully attached to lid base 100, because tab 102 has not yet caused scored flap 104 to separate from a top portion of lid base 100. In some embodiments, tab 102 can be connected to any suitable portion of lid base 100 (e.g., a center portion, and/or any other suitable portion) in any suitable manner. For example, in some embodiments, tab 102 can be connected to lid base 100 via a rivet in tab rivet area 110. Note that, in some such embodiments, a rivet in tab rivet area 110 can be a rivet that is part of lid base 100 (e.g., as shown in and described below in connection with FIGS. 10A, 10B, and/or 10C), a rivet that is part of tab 102 in tab rivet area 110 (e.g., as shown in and described below in connection with FIG. 3E), and/or an independent rivet inserted in tab rivet area 110 (e.g., as shown in and described below in connection with FIGS. 4A, 4B, and 4C).

In some embodiments, tab 102 can cause a portion of scored flap 104 to at least partially separate from lid base 100, thereby opening lid base 100, as illustrated in FIG. 1B. In some embodiments, opening lid base 100 can cause an opening 106 of lid base 100 to be exposed. In some embodiments, tab 102 can cause the portion of scored flap 104 to separate from lid base 100 in any suitable manner. For example, in some embodiments, a tip of tab 102 that is above scored flap 104 can be pressed into scored flap 104, thereby causing a portion of scored flap 104 to be pressed into an interior of a can body attached to lid base 100. In some embodiments, the tip of tab 102 can be pressed into scored flap 104 in any suitable manner. For example, in some embodiments, tab 102 can be operated as a second class lever and a first class lever around a corresponding to tab rivet area 110 by lifting a back end of tab 102 that is opposite the tip of tab 102, thereby causing the tip of tab 102 to apply pressure to scored flap 104.

As shown in FIG. 1B, in some embodiments, tab 102 can be connected to a closure flap 108 in any suitable manner including a rivet, welding, recyclable sealant, rubber, recyclable glue, links, and/or in any other suitable manner. For example, in some embodiments, tab 102 can be connected to closure flap 108 via a rivet corresponding to tab rivet area 110. Note that, in some embodiments, the rivet corresponding to tab rivet area 110 can be part of lid base 100 (e.g., as shown in and described below in connection with FIG. 10A), part of tab 102 (e.g., as shown in and described below in connection with FIG. 3E), and/or an independent rivet (e.g., as shown in and described below in connection with FIGS. 4A, 4B, and 4C).

As shown in FIG. 1B, in some embodiments, closure flap 108 can have a size and a shape that corresponds to opening 106, thereby allowing closure flap 108 to be inserted into opening 106 to re-close and seal lid base 100 after scored flap 104 of lid base 100 has been opened.

Note that, as shown in FIG. 1B, tab 102 can be joined by a rivet corresponding to tab rivet area 110, thereby allow tab 102 to rotate in conjunction with closure flap 108, either clockwise or counterclockwise. For example, in some embodiments, closure flap 108 can be rotated to a position suitable for insertion of closure flap 108 into opening 106 to seal opening 106.

Additionally, note that, in some embodiments, scored flap 104 can have any suitable size and/or any suitable shape depressions. In some embodiments, scored flap 104 can be scored or perforated to allow a portion of scored flap 104 to separate from lid base 100 when a tip of tab 102 is depressed on scored flap 104 to open lid base 100. Note that, when opened, in some embodiments, scored flap 104 can remain attached to lid base 100 via a link 112. In some embodiments, any suitable portion of scored flap 104, link 112, and/or lid base 100 can be scored or perforated to allow any portion of scored flap 104 to bend from lid base 100 when lid base 100 is opened to allow the portion of scored flap 104 to remain attached to lid base 100 while providing a seal between closure flap 108 and opening 106.

In some embodiments, scored flap 104 can be scored in multiple ways around a circumference of opening 106 and at link 112. In some embodiments, scored flap 104, where it meets link 112, can curl upward and inward toward the center of lid base 100, such as shown in and described below in connection with FIG. 5C. As another example, in some embodiments, scored flap 104, where it meets link 112, can be scored such that it is a dead end stop with no curl as shown in and described below in connection with FIG. 5A. As yet another example, in some embodiments, scored flap 104, where it meets link 112, can be scored such that it can curl down and inward toward the center of scored flap 104 as shown in and described below in connection with FIG. 5D.

In some embodiments, an underside of link 112 can be perforated in any suitable manner (e.g., as shown in and described below in connection with FIG. 5B) to create a more desirable angle to provide a seal of closure flap 108 over opening 106 of lid base 100 and link 112. For example, in some embodiments, the underside of link 112 adjacent to a point at which link 112 connects to lid base 100 when lid base 100 is open can have small cuts or indents such that scored flap 104 bends around the perforations of link 112 when lid base 100 is open. In some embodiments, a depth of the perforations of the underside of link 112 can be deep enough to allow scored flap 104 to bend straight inward into opening 106 and around link 112 area but shallow enough that link 112 remains connected to lid base 100 when lid base 100 is opened.

Figure 2A:
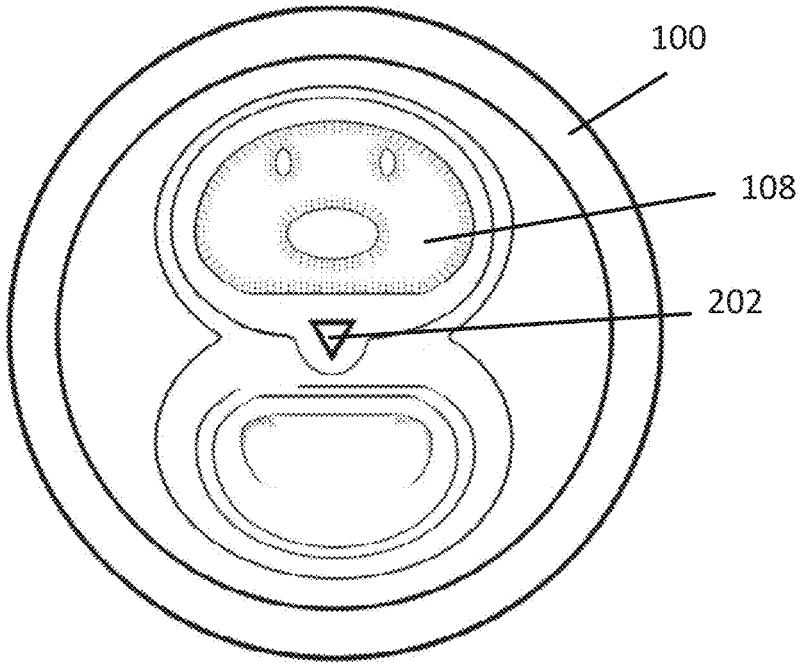
FIG. 2A shows a top view of reclosable can end with the lid base and closure flap in accordance with some embodiments of the disclosed subject matter.

Turning to FIG. 2A, an example of lid base 100 without a tab and when lid base 100 has not yet been opened (that is, scored flap 104 has not been pressed down) is shown in accordance with some embodiments of the disclosed subject matter. Note that, as shown in FIG. 2A, closure flap 108 can be positioned in a portion (e.g., a recessed portion, and/or any other suitable portion) of lid base 100 when closure flap 108 is not in use.

Figure 2B:
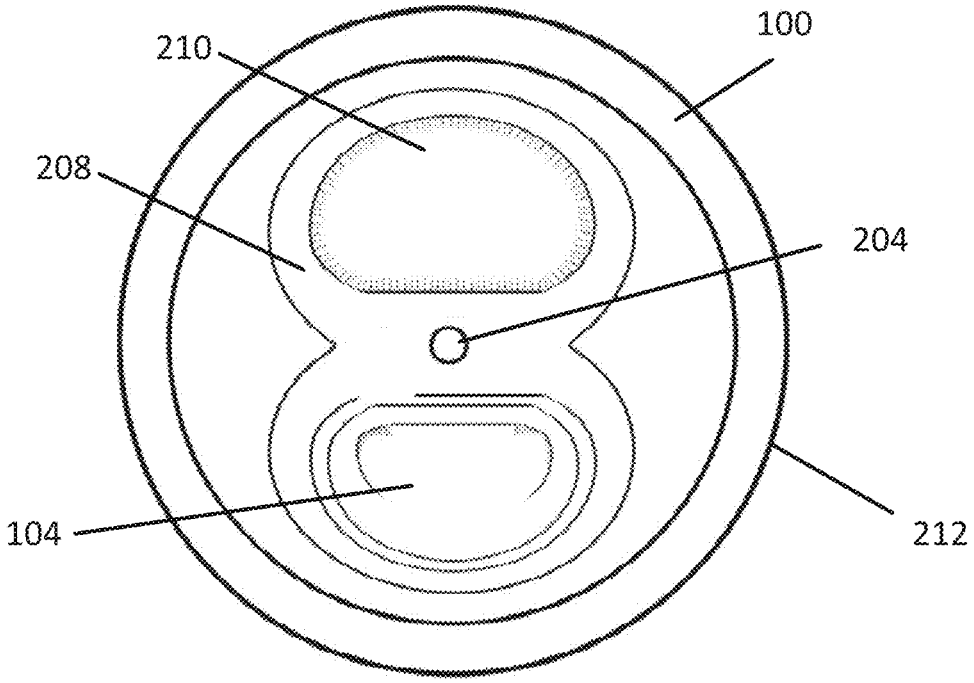
FIG. 2B shows a top view of a reclosable can end with the lid base and without an attached tab, rivet, or closure flap in accordance with some embodiments of the disclosed subject matter.

Turning to FIG. 2B, an example of lid base 100 without a tab and without a closure flap, when lid base 100 has not yet been opened is shown in accordance with some embodiments of the disclosed subject matter.

Note that, in some embodiments, a lid base 100 can include a drip-catch 208 (e.g., that catches liquid that comes out of an opening of lid base 100 when open), a lid base pocket 210, a lid base rivet area 204, and a rim 212.

In some embodiments, drip-catch 208 of lid base 100 can have any suitable lid base pocket 210 with any type of depression, angle, edges, shape, arch, depth and width. In some embodiments, lid base pocket 210 can be used as a holding area for closure flap before lid base 100 is opened or when lid base 100 is re-opened. In some embodiments, lid base pocket 210 can be under a closure flap and can then be exposed once the closure flap is turned.

In some embodiments, drip-catch 208 can have a width or depth that is wide enough or deep enough to accommodate an opening of lid base 100 or a closure flap. As a more particular example, in an instance in which an opening of lid base 100 is wider than an opening of a traditional soda can, drip-catch 208 of lid base 100 can be relatively wider and more oval than a drip-catch of a traditional can end. In some embodiments, drip-catch 208 can include padding of any suitable type of material.

Referring to FIGS. 2A and 2B, shapes of rivet areas of a closure flap (e.g., closure flap 108 as shown in FIG. 2A) and a lid base (e.g., lid base 100 as shown in FIG. 2B) are shown in accordance with some embodiments of the disclosed subject matter. For example, referring to FIG. 2A, in some embodiments, any suitable rivet can be inserted in a closure flap rivet area 202 to couple closure flap 108 to a tab (not shown). Note that, in some embodiments, a rivet inserted in closure flap rivet area 202 can be any suitable rivet, such as a rivet that is part of the tab (e.g., as shown in and described below in connection with FIG. 3E), a rivet that is part of a lid base (e.g., as shown in and described below in connection with FIG. 10), and/or an independent rivet (e.g., as shown in and described below in connection with FIGS. 4A, 4B, and 4C). Additionally, note that, although closure flap rivet area 202 is shown as triangular in shape, in some embodiments, closure flap rivet area 202 can have any suitable shape (e.g., square, round, hexagonal, and/or any other suitable shape).

As another example, referring to FIG. 2B, in some embodiments, any suitable rivet can be used in lid base rivet area 204 to connect lid base 100 to a tab and closure flap. Note that, in some embodiments, the rivet can be a rivet that is part of the lid base (e.g., as shown in and described below in connection with FIGS. 10A, 10B, and/or 10C) that is located at lid base rivet area 204 on lid base 100, a rivet that is part of the tab (e.g., as shown in and described below in connection with FIG. 3E) that is inserted through the closure flap and through lid base rivet area 204, and/or an independent rivet (e.g., as shown in and described below in connection with FIGS. 4A, 4B, and 4C). Additionally, note that, although lid base rivet area 204 is shown as circular in shape, in some embodiments, lid base rivet area 204 can be any suitable shape (e.g., square, triangular, hexagonal, and/or any other suitable shape). In some embodiments, lid base rivet area 204 can be smaller or larger than closure flap rivet area 202.

Note that, although tab 102, closure flap 108, and lid base 100 are shown in and described above in connection with FIGS. 1A, 1B, 2A, and 2B, in some embodiments, any suitable alternative designs of tabs, closure flaps, lid bases, and rivets can be used in any suitable combination. For example, in some embodiments, alternative tab designs (e.g., as shown in and described below in connection with FIG. 3A, 3B, 3C, 3D, 3E, 9A, and/or 9F), alternative closure flap designs (e.g., as shown in and described below in connection with FIG. 6A, 6B, 6C, 7A, 7B, 7C, 8, 9A, 9B, 9C, 9D, and/or 11), alternative rivet designs (e.g., as shown in and described below in connection with FIGS. 4A, 4B, 4C, 9A, 9B, 9C, 9D, 9E, 9F, 9G, 10A, 10B, and/or 10C), and/or alternative lid base designs (e.g., as shown in and described below in connection with FIGS. 10A, 10B, 10C, and/or 11) can be used in any suitable combination.

Figure 3A:
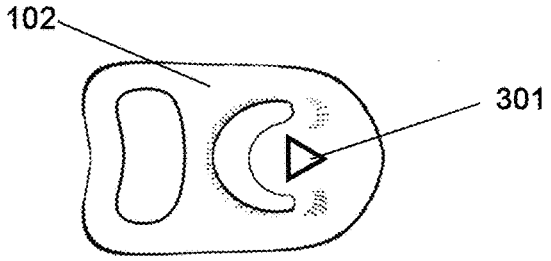
FIGS. 3A, 3B, 3C, and 3D show views of a tab in accordance with some embodiments of the disclosed subject matter.

Turning to FIG. 3A, a top view of tab 102 is shown in accordance with some embodiments of the disclosed subject matter. Note that tab 102 is shown in FIG. 3A with a tab rivet area 301 that is triangular in shape. In some embodiments, a tab can have a rivet area with any suitable shape (e.g., circular, triangular, square, L-shaped, hexagonal, and/or any other suitable shape). For example, as shown in FIG. 3C, a tab can have a round tab rivet area 312.

Figure 3B:
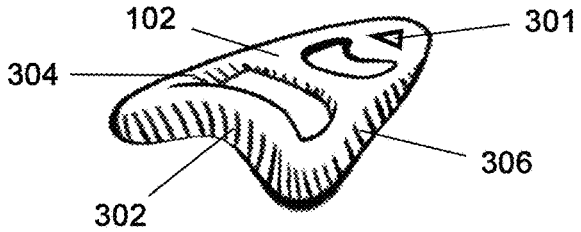
Figure 3C:
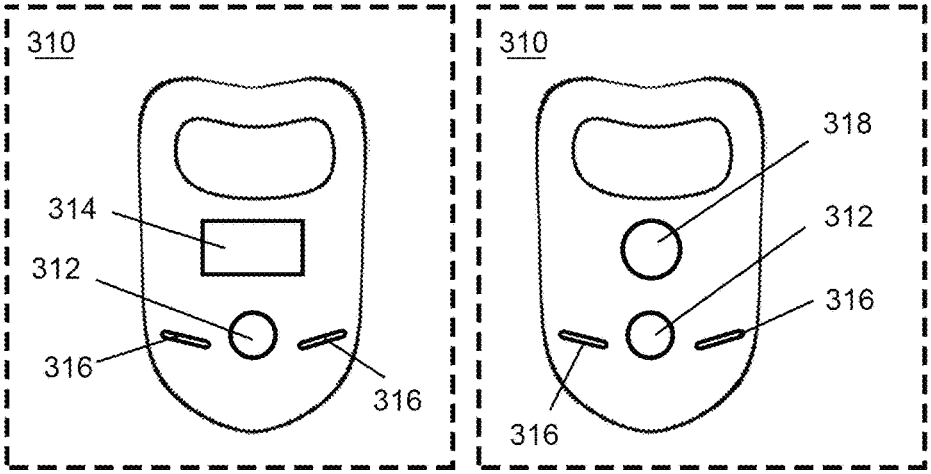

Turning to FIG. 3B, an angled side view of a tab 102 is shown in accordance with some embodiments of the disclosed subject matter. In some embodiments, a force part 302 of tab 102 (e.g., a back portion of a tab) can have an arched or concave shape that allows tab 102 to be pulled upward by a finger and to be rotated. Additionally, note that tab 102 can have any suitable shape or dimensions that differ from tabs used in other drink cans. For example, in some embodiments, tab 102 can have a thicker force part 302 and/or thicker side portions 304 and/or 306 relative to tabs used in other drink cans. As another example, in some embodiments, a length and/or a width of tab 102 from force part 302 to tab rivet area 301 can be different in shape than tabs used in other drink cans (e.g., longer, shorter, wider, thinner, and/or different in any other suitable manner).

Figure 4A:
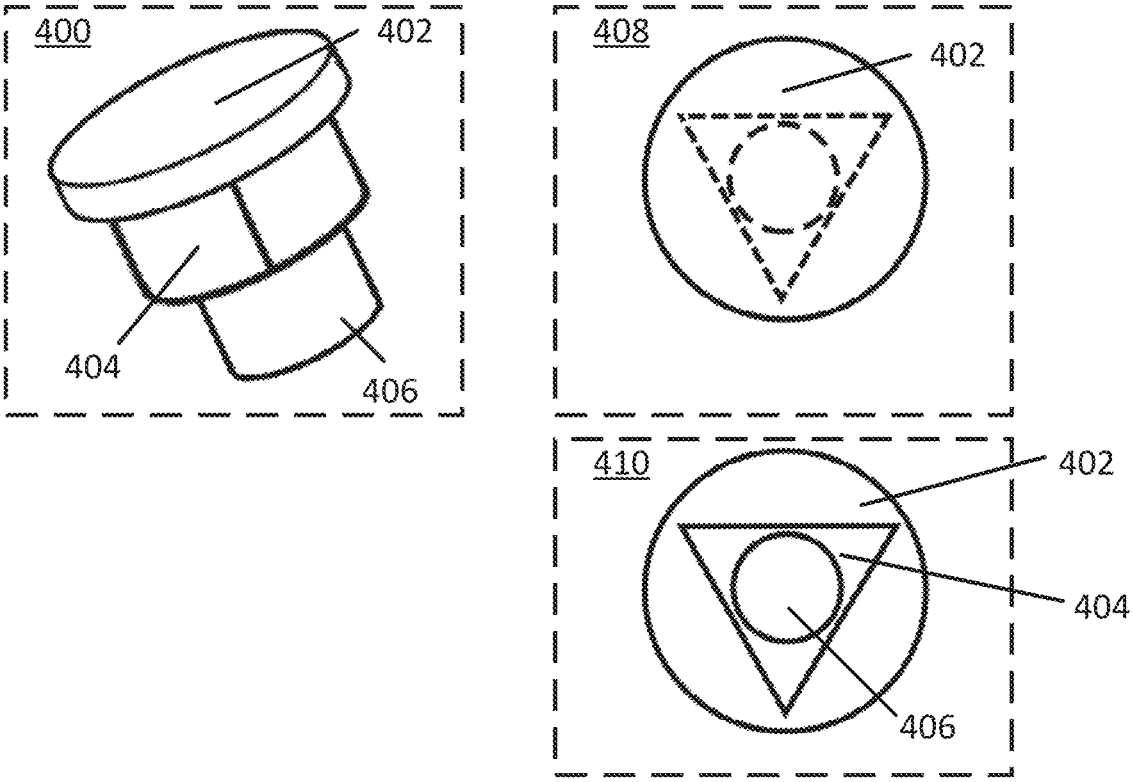
FIGS. 4A, 4B, and 4C show example views of an independent rivet for attaching a tab, closure flap, and lid base in accordance with some embodiments of the disclosed subject matter.
Figure 4B:
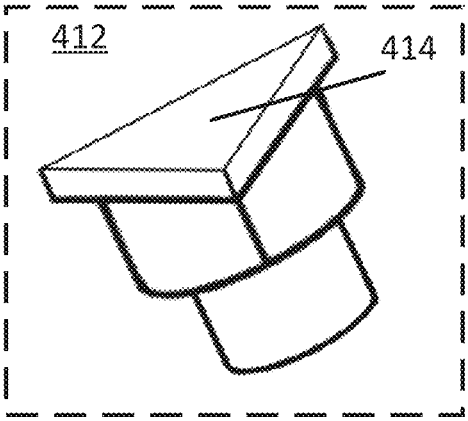
Figure 4C:
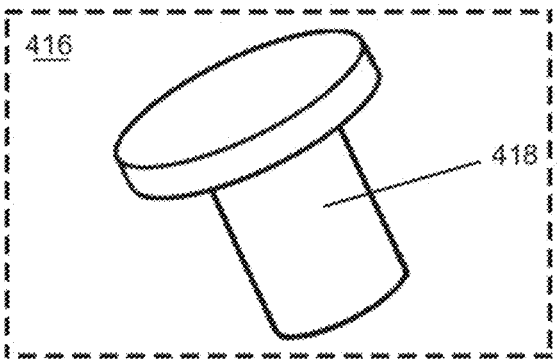

In some embodiments, a tab, a closure flap, and a lid base can be coupled using an independent rivet (e.g., a rivet that is not a part of any of the tab, the closure flap, and/or the lid base). FIGS. 4A, 4B, and 4C show examples of independent rivets that can be used to couple any of a tab, a closure flap, and/or a lid base.

Turning to FIG. 4A, example views of an independent rivet with a circular top portion are shown in accordance with some embodiments of the disclosed subject matter. View 400 shows a three-dimensional side view of a rivet. As illustrated, the rivet includes a circular top portion 402, a triangular middle portion 404, and a circular bottom portion 406. In some embodiments, circular top portion 402 can overlap a tab and can lock into a tab rivet area and a closure flap rivet area, thereby holding both the tab and the closure flap to a lid base. In some embodiments, triangular middle portion 404 can act as a lock between the closure flap and the tab, thereby allowing the tab and the closure flap to rotate as one piece. In some embodiments, circular bottom portion 406 can go through lid base rivet area 204 (as shown in and described above in connection with FIG. 2B) of lid base 100 thereby allowing the tab and the closure flap to rotate together. In some embodiments, circular bottom portion 406 can be flattened by machinery to secure the rivet, as shown in and described below in connection with FIG. 9G.

FIG. 4A additionally shows a top view 408 and a bottom view 410 of the rivet shown in view 400. Note that, as shown in FIG. 4A, in some embodiments, circular top portion 402 can have the largest area of the three portions of the rivet, and circular bottom portion 406 can have the smallest area of the three portions of the rivet. Note that, in some embodiments, each section of a rivet can vary in height, width, length, circumference, and/or in any other suitable manner.

Turning to FIG. 4B, an example 412 of a rivet with a triangular top portion 414 is shown in accordance with some embodiments of the disclosed subject matter.

Turning to FIG. 4C, an example 416 of a rivet with a round top and a cylindrical body 418 is shown in accordance with some embodiments of the disclosed subject matter.

In some embodiments, shapes of holes of a closure flap can correspond to portions of a rivet. For example, in some embodiments, rivet 416 (as shown in and described above in connection FIG. 4C) can connect a tab with a circular tab rivet area to a closure flap with a circular closure flap rivet area. In some embodiments, this can allow the rivet and the closure flap to turn either clockwise or counter-clockwise.

It should be noted that the illustrated relative dimensions may differ from an actual rivet implemented in accordance with some embodiments. For example, in some embodiments, the height of each portion of 402, 404, 406, and 418 may be shorter than a width and/or a diameter of that portion. In some embodiments, the heights may be exaggerated herein for clarity.

Figure 5A:
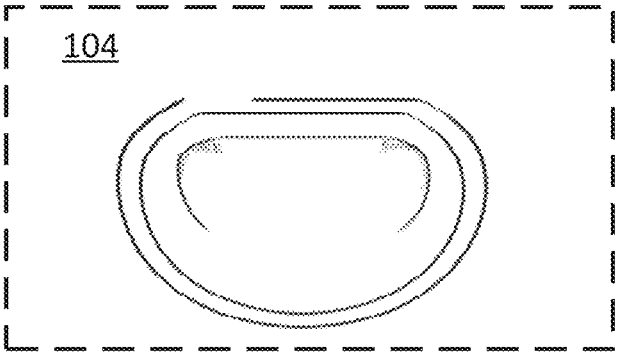
FIGS. 5A, 5B, 5C, and 5D show example views of a scored flap and perforations corresponding to a can opening in accordance with some embodiments of the disclosed subject matter.
Figure 5B:
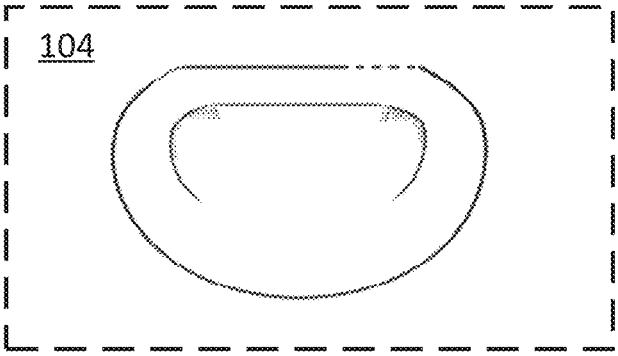
Figure 5C:
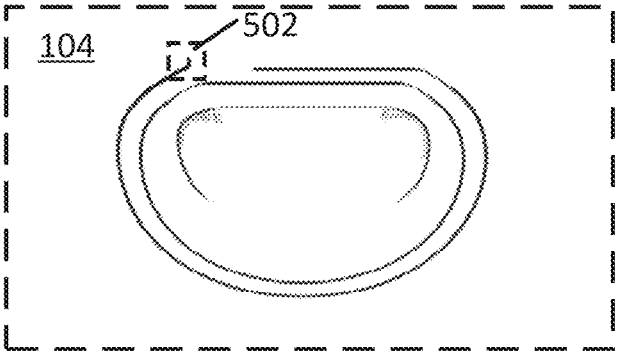
Figure 5D:
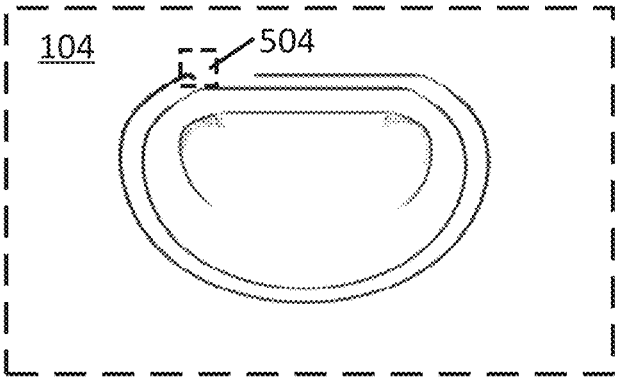

Turning to FIG. 5A, an example top view of a scored flap of a lid base (e.g., such as scored flap 104 as shown in and described above in connection with FIG. 1B) is shown in accordance with some embodiments of the disclosed subject matter. FIG. 5B shows an example bottom view of the scored flap with perforations on the lid base. FIG. 5C shows an example top view of an alternate curved up scored area 502 where it meets link 112. FIG. 5D shows an example top view of an alternate curved down scored area 504 where it meets link 112. Note that, in some embodiments, any suitable scored flap can be used in connection with any lid base.

Figure 6A:
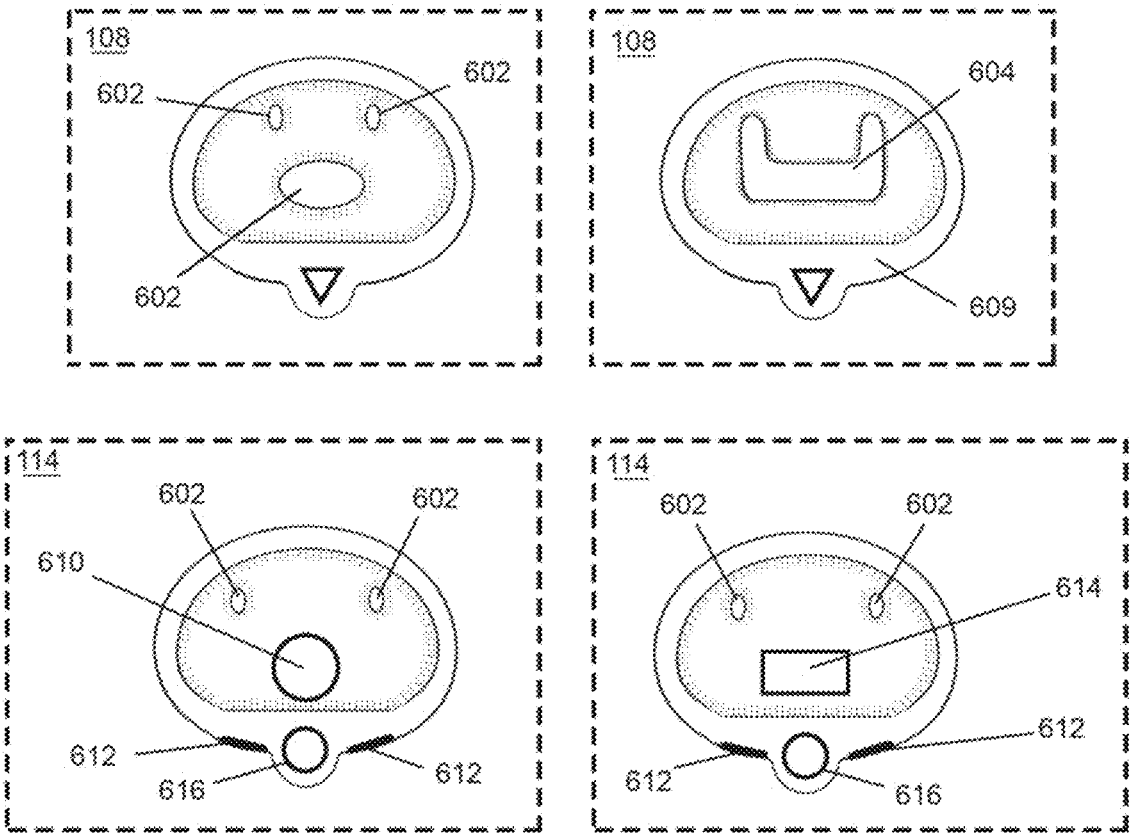
FIGS. 6A, 6B, and 6C, show views of a closure flap in accordance with some embodiments of the disclosed subject matter.
Figure 6B:
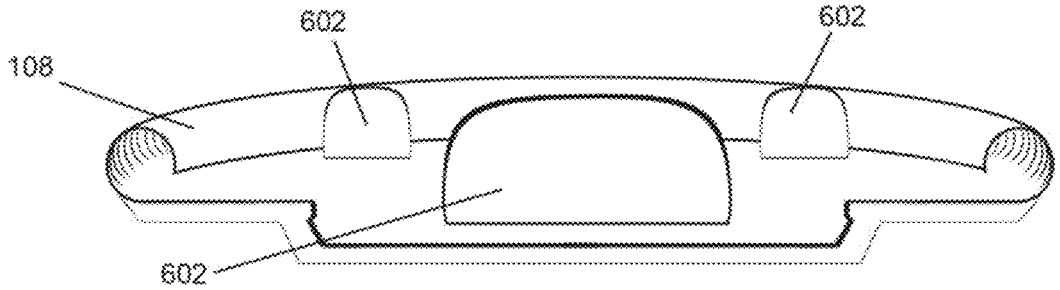
Figure 6C:
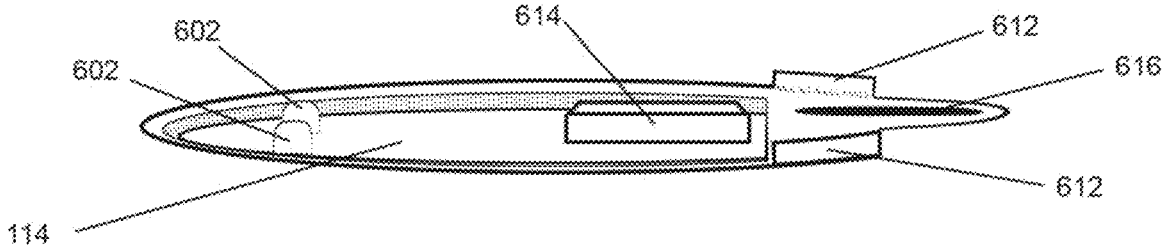

In some embodiments, a closure flap can include any suitable elements that can allow a tab to exert pressure on a closure flap when a closure flap is inserted into an opening of a can to allow a more unified and/or tighter seal to be formed between the closure flap and the opening of the can. Additionally, a closure flap can include any suitable elements that allow a tab to rotate a connected closure flap. FIGS. 6A, 6B, and 6C show examples of closure flaps with various design elements. Note that, in some embodiments, any of the elements shown in FIGS. 6A, 6B, and/or 6C can be combined in any suitable manner in a closure flap.

As shown in FIGS. 6A, 6B, and 6C, in some embodiments, a closure flap can have one or more variously shaped bumps, molds, raises, flaps, lips, or other designs. In some embodiments, a bump on a closure flap can aid a lock between a tab and the closure flap, aid in pushing and pulling the connected tab and closure flap, allow a tab to exert even pressure on a closure flap when the closure flap is inserted into an opening of a lid base, and/or perform any other suitable functions. In some embodiments, a closure flap can include any suitable bumps, such as bump 602 and/or bump 604 as shown in FIG. 6A, bump 610 and/or bump 614 as shown in FIGS. 6A and 6C, and/or any other suitable bumps. In some embodiments, the one or more bumps can correspond to raised portions of an interior of the closure flap. Note, that, in some embodiments, a closure flap can include any suitable number of bumps (e.g., zero, one, two, three, five, and/or any other suitable number), each located at any suitable position on the closure flap. In some embodiments, the one or more bumps on a closure flap can be generated in any suitable manner, for example, by using any suitable welding or molding technique (e.g., using injection molding and/or any other suitable molding, welding, or shaping technique).

In some embodiments, the one or more bumps can meet a bottom portion of a tab, which can cause the tab to exert even pressure on the closure flap when the closure flap is inserted into an opening of an open can, thereby allowing a more unified and/or tighter seal to be formed between the closure flap and an opening of the can. In addition, the one or more bumps can act and engage as a lock with a tab to assist in rotation of the closure flap over an opening of the can end. Note that examples of closure flaps with one or more bumps that meet a bottom portion of a tab are shown in and described below in more detail in connection with FIGS. 7A, 7B, and 7C. Turning to FIG. 3C, in some embodiments, a square shaped bump (e.g., bump 614 of FIGS. 6A and 6C) can fit into a square shaped tab opening 314 of a tab 310. As another example, in some embodiments, a round shaped bump (e.g., bump 610 of FIG. 6A) can fit into a round shaped tab opening 318 of tab 310. Note that, in some embodiments, each bump on a closure flap can have any suitable shape (e.g., round, square, rectangular, L-shaped, U-shaped, triangular, hexagonal, and/or any other suitable shape). Additionally, note that, in some embodiments, a tab can have openings of any suitable shape(s) that correspond to bumps of a closure flap that is to be connected to the tab.

Figure 3D:
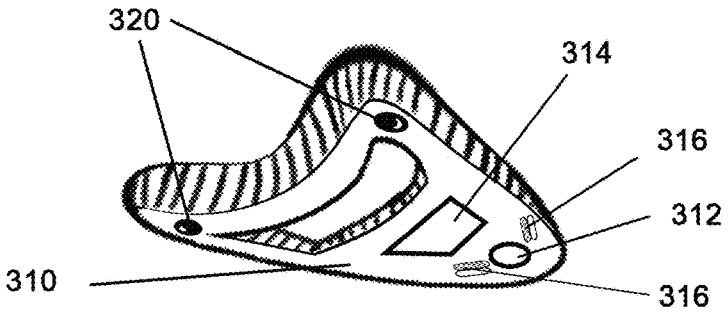

Referring back to FIG. 6A, top views of an alternate closure flap 114 are shown in accordance with some embodiments of the disclosed subject matter. In some embodiments, closure flap 114 can include one or more closure flap lips 612 (as shown in FIGS. 6A and 6C). In some embodiments, closure flap lips 612 can act as a lock or a hook that engages with lips on a tab. For example, turning to FIGS. 3C and 3D, tab 310 can include tab lips 316. In some embodiments, as a tab turns, closure flap lips 612 can act as pressure points against tab lips 316. In some embodiments, when the tab turns, both closure flap lips 612 and tab lips 316 can aid in the rotation (e.g., pushing or pulling a connected tab and closure flap), clockwise or counter-clockwise, and locking of the tab to closure flap 114 while still allowing the tab to rotate. Note that, referring to FIG. 3D, in some embodiments, a tab can additionally include pressure points 320. In some embodiments, when pressure is applied to pressure points 320, the tab can engage with a connected closure flap to create a secure seal of the closure flap in an opening of a lid base. In some embodiments, pressure points 320 can be any suitable added material, bumps, and/or punctures. In some embodiments, pressure points 320 can be formed from any part of a mold and/or in any other suitable manner. Note that FIG. 3D shows an underside of tab 310.

Referring back to FIG. 6A, in some embodiments, a closure flap can have an outer edge 609 that acts as an edge, lip, glide, flap, ledge, or seal. In some embodiments, outer edge 609 can extend beyond opening 106 and can allow for a seal when the closure flap is positioned over and seals opening 106. In some embodiments, outer edge 609 can additionally aid in rotation of the closure flap over the lid base.

Turning to FIG. 6B, an example cross-sectional side view of a closure flap is shown in accordance with some embodiments of the disclosed subject matter. Note that, in some embodiments, side edges of a closure flap can have any suitable shape(s) (e.g., angles, curves, bends, arches, cuts, bumps, molds, and/or any other suitable designs), such as shown in and described below in more detail in connection with FIGS. 7A, 7B, 7C, and 8.

Turning to FIG. 6C, an example side view of a closure flap is shown in accordance with some embodiments of the disclosed subject matter. Note that, in some embodiments, side edges of a closure flap can have any suitable shape(s), as shown in and described below in more detail in connection with FIGS. 7A, 7B, 7C, 8, 9B, 9C, and/or 9D.

Figure 7A:
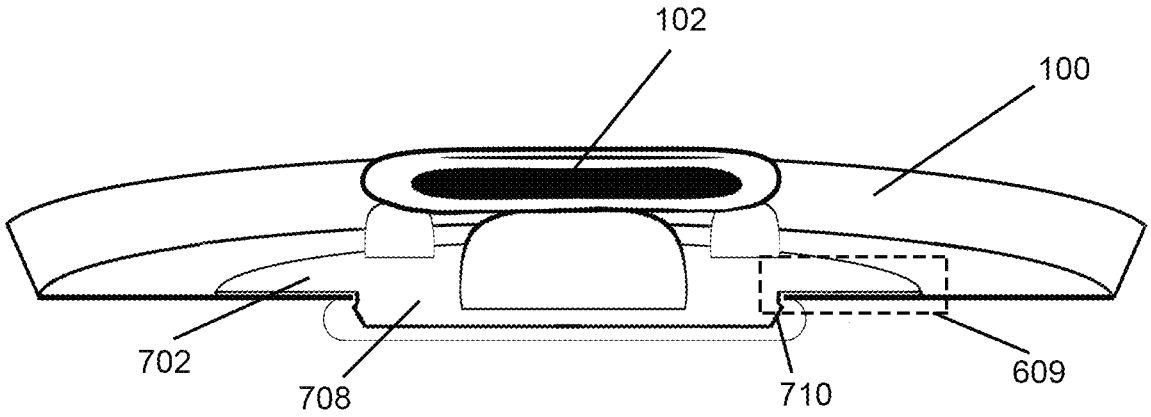
FIGS. 7A, 7B, and 7C show cross-sectional side views of lid base, closure flap, and tab in accordance with some embodiments of the disclosed subject matter.
Figure 7B:
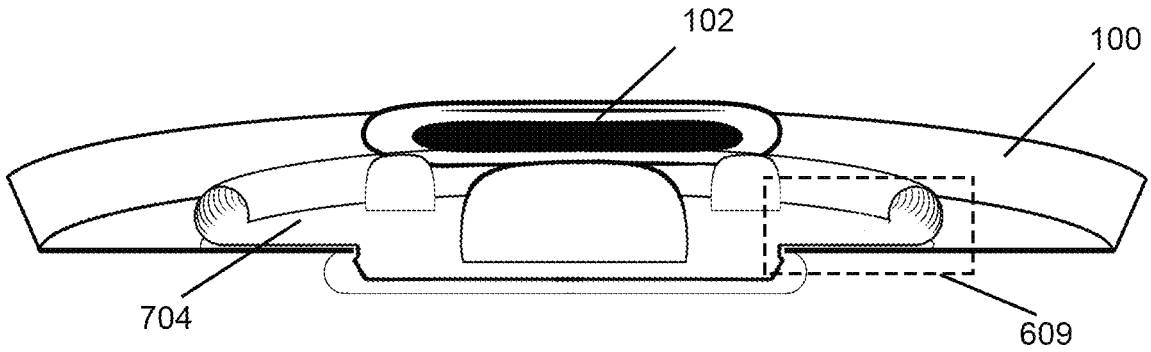
Figure 7C:
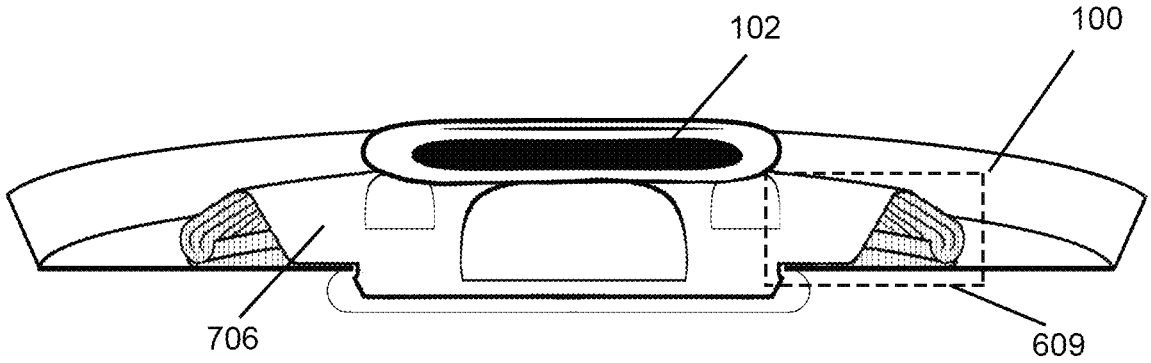

Turning to FIGS. 7A, 7B, and 7C, example cross-sectional side views of closure flaps, with a tab and a lid base, of different shapes inserted into an opening of a lid base are shown in accordance with some embodiments of the disclosed subject matter. Note that FIGS. 7A, 7B, and 7C each show three different potential edge shapes 702, 704, and 706, respectively, of closure flaps. Additionally, note that the shapes of closure flaps shown in FIGS. 7A, 7B, and 7C are shown merely as examples, and, in some embodiments, any suitable shape can be used. Note that additional possible shapes of closure flaps are shown in and described below in connection with FIGS. 8, 9B, 9C, and/or 9D. Additionally, note that, in FIGS. 7A, 7B, and 7C, outer edge 609 of each closure flap is shown on top of lid base 100.

Note that, in some embodiments, the closure flap and/or bumps on the closure flap can each be made of any suitable material. For example, in some embodiments, the closure flap and/or the bumps can each be made of the same material as the can, such as aluminum or an aluminum alloy. In some embodiments, the closure flap and/or the bumps on the closure flap can each be made of any suitable material that allows the closure flap and/or the bumps to be recycled along with the can.

Additionally, note that, in some embodiments, the closure flap can have a depressed pocket (e.g., a depressed pocket 708 as shown in FIG. 7A) in the center that has dimensions that correspond to dimensions of an opening of an open can (e.g., opening 106 as shown in and described above in connection with FIG. 1B).

In some embodiments, a bottom portion of the closure flap can have a lining sealant (e.g., lining sealant 710 as shown in FIG. 7A) of any suitable material, such as the same coating as the interior of the can body or any other suitable material. Note that, in some embodiments, any suitable type of sealant can be used, such as a sealant used in a lining or interior of the can (e.g., epoxy resin, any suitable polymer plastic, and/or any other suitable sealant). In some embodiments, the sealant can be any suitable sealant that satisfies any suitable criteria, such as being harmless to a consumer (e.g., BPA-free, and/or any other suitable harmless sealant), recyclable with aluminum, does not contaminate and/or change a taste of a beverage in a can, and/or that satisfies any other suitable criteria. In some embodiments, the lining sealant can have any suitable layers and/or can have any suitable thickness that can aid in sealing the opening of the can end and/or can aid in ease of use. In some embodiments, the lining sealant can have any suitable dimensions to correspond to a portion of a bottom of a corresponding closure flap or to the entire bottom of a corresponding closure flap. Additionally or alternatively, note that, in some embodiments, the closure flap can be covered prior to first use with a breakable sealant that prevents contaminants from entering an area under the closure flap.

Figure 8:
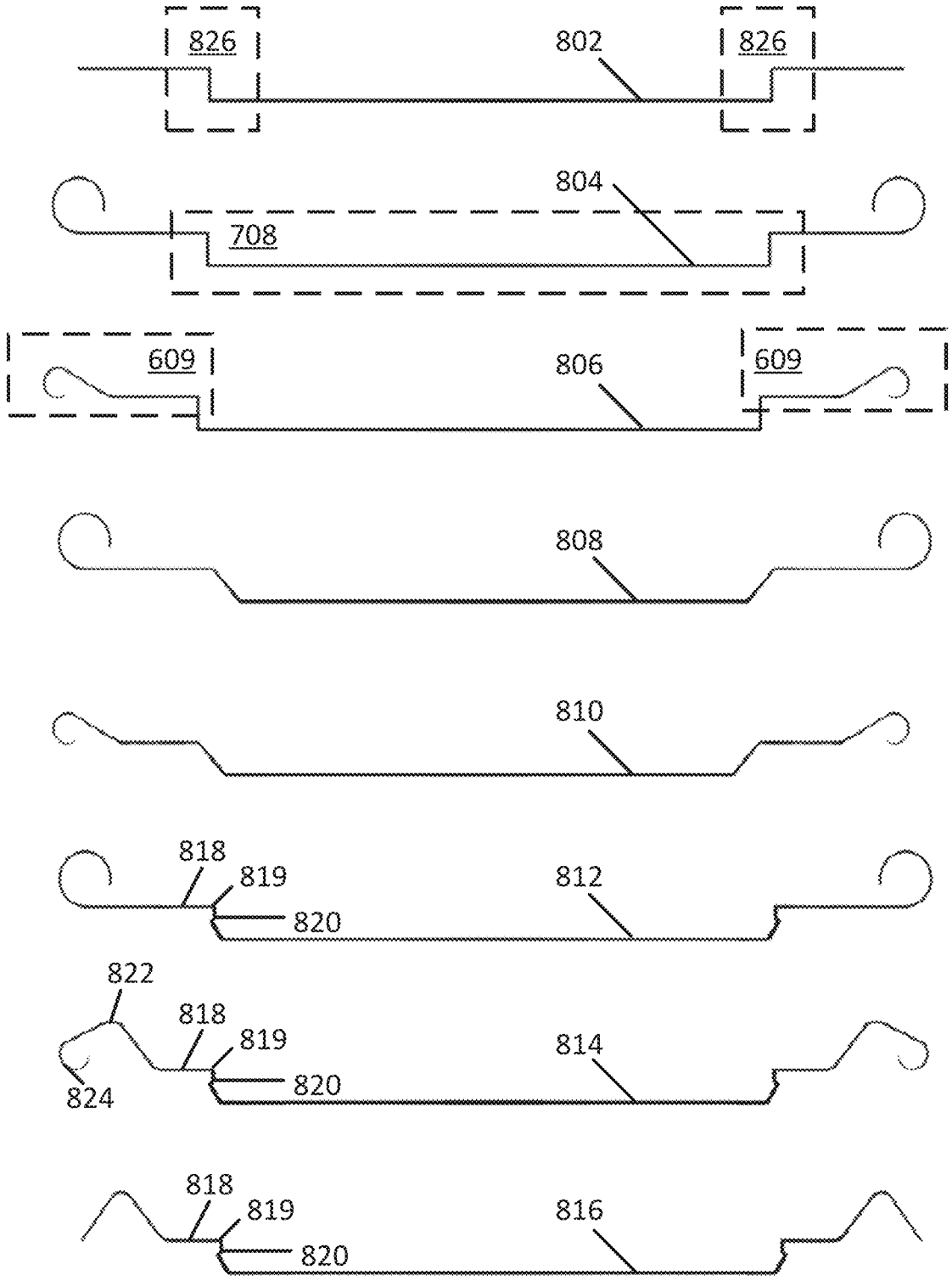
FIG. 8 shows example cross-sectional side views of shapes for closure flaps in accordance with some embodiments of the disclosed subject matter.

Turning to FIG. 8, example cross-sectional side views of closure flaps of different shapes are shown in accordance with some embodiments of the disclosed subject matter. As illustrated, eight shapes, 802, 804, 806, 808, 810, 812, 814, and 816 are shown with multiple design options and/or combination options. Note that, as illustrated in FIG. 8, a closure flap can have any suitable dimensions, and any suitable shape that includes any suitable angles, cuts, edges, padding, grooves, molds, lips, pressure points, curls, and/or any other suitable designs.

In some embodiments, a closure flap can have sections that can include: 1.) depressed pocket 708 (as shown in and described above in connection with FIG. 7A); 2.) a closure seal lock area 826; and 3.) outer edge 609 (as shown in and described above in connection with FIG. 6). For example, in some embodiments, depressed pocket 708 can be various depths, angles, shapes, and/or widths in relationship to a closure seal lock area 826 for insertion inside of a lid base opening and/or insertion inside of a holding area of a lid base pocket (e.g., lid base pocket 210 of FIG. 2B), to accommodate movement of the closure flap (e.g., during rotation or positioning of the closure flap during opening or closing) and/or to aid in insertion of the closure flap in a lid base opening.

As another example, in some embodiments, as shown in shapes 812, 814, and 816, the closure flap can include a straight edge 818 that is connected to angle drop 819 of any suitable angle (e.g., 40 degrees, 45 degrees, 50 degrees, and/or any other suitable angle), that leads to an under-cut/indent 820 that acts as a hook. In some embodiments, under-cut/indent 820 can be positioned underneath an edge of opening 106 once lid base 100 is open. In some embodiments, this can allow for a seal of the closure flap over opening 106 such that the seal does not interfere with link 112 but allows the closure flap to work in conjunction with link 112 to seal a lid base opening.

As yet another example, in some embodiments, outer edge 609 of shape 814 can act with a spring-like action when the closure flap is depressed in the middle via an attached tab to provide resistance or assistance when the closure flap is depressed in a lid base opening and/or when the closure flap is rotated by a coupled tab. Note that shape 814 includes an upward arch and downward bend 822 into a curled edge 824 that can tuck under the arch 822 and which can sit on top of a drip catch of a lid base, which can be used to provide the spring-like action, resistance, pressure, and/or any other suitable function to assist a tight and non-leakable seal of the closure flap over a lid base opening and a link of a lid base opening (e.g., link 112, as shown in and described above in connection with FIG. 1B). Additionally, in some embodiments, curled edge 824 can provide a smooth surface area to an outer edge 609 of the closure flap such that the closure flap does not have an abrasive edge.

Figure 11:
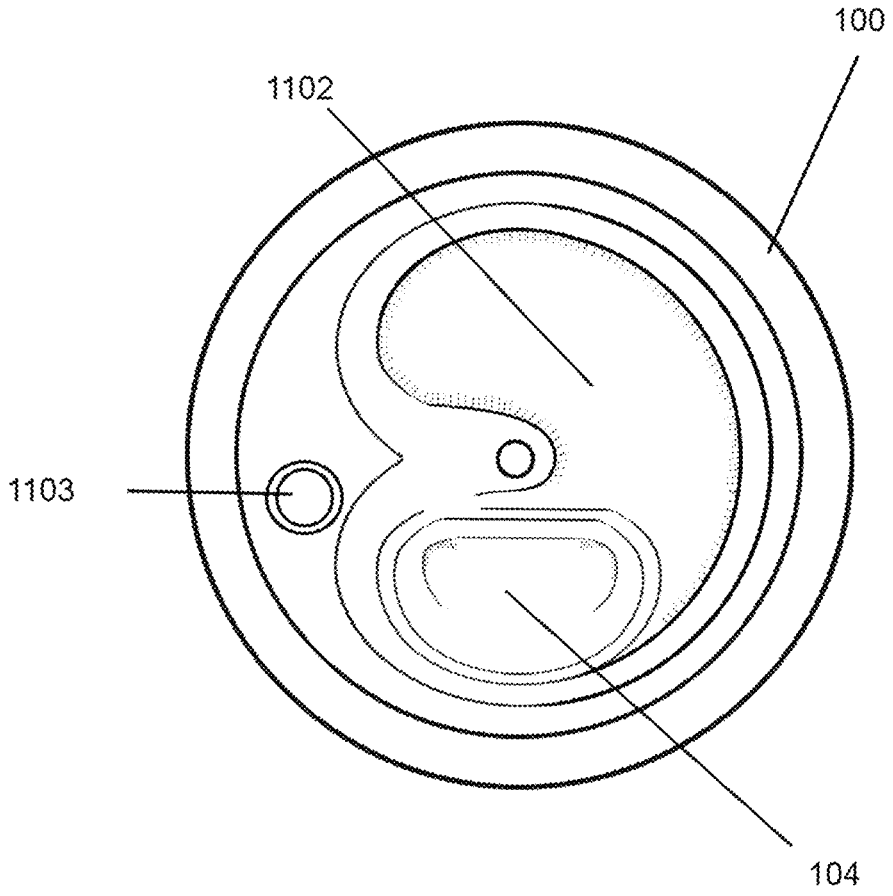
FIG. 11 shows an example of a lid base with a slide area for a closure flap and a push button in accordance with some embodiments of the disclosed subject matter.

In some embodiments, a lid base can have a slide area in which a closure flap can move during rotation of the closure flap in and out of a lid base opening. In some embodiments, the slide area can aid in movement and/or rotation of the closure flap. Turning to FIG. 11, a top view of a lid base is shown in accordance with some embodiments of the disclosed subject matter. As illustrated, the lid base has a slide area 1102. In some embodiments, slide area 1102 can be level with a scored flap of the lid base (e.g., scored flap 104). Alternatively, in some embodiments, slide area 1102 can slope in any suitable direction (e.g., upward toward scored flap 104, downward toward scored flap 104, and/or in any suitable direction). Note that, in some embodiments, slide area 1102 can be any suitable portion of the lid base. For example, in some embodiments, as shown in FIG. 11, slide area 1102 can be a subset of the top area of the lid base (e.g., a right side of the lid base, a left side of the lid base, and/or any other suitable area of the lid base). As another example, in some embodiments, slide area 1102 can be a full top portion of the lid base. Note that, in some embodiments, slide area 1102 can be used in connection with any combination of any suitable tab, rivet(s), closure flap, scored area, link(s), and/or any other suitable elements of a can end described herein.

In some embodiments, as shown in FIG. 11, the lid base can include a push button 1103. In some embodiments, push button 1103 can act as a pressure point. In some embodiments, push button 1103 can be depressed to aid in rotation of closure flap out and away from the lid base opening to re-open the can end by loosening a connection of the closure flap within the lid base opening. Note that, in some embodiments, push button 1103 can be included in any suitable lid base and can be located at any suitable position on the lid base. Additionally, note that, in some embodiments, push button 1103 can be of any suitable shape and/or size (e.g., round, square, rectangular, triangular, L-shaped, and/or any other suitable shape). In some embodiments, push button 1103 can be formed via any suitable manufacturing technique(s) (e.g., any suitable molding technique, a pulled or pushed force manufacturing technique(s) as part of the lid base, welded onto the lid base, extruded from the lid base, and/or any other suitable technique(s)). In some embodiments, push button 1103 can be omitted.

Turning to FIGS. 9A, 9B, 9C, 9D, and 9F, another example of a tab and a closure flap are shown in accordance with some embodiments of the disclosed subject matter.

Figure 9A:
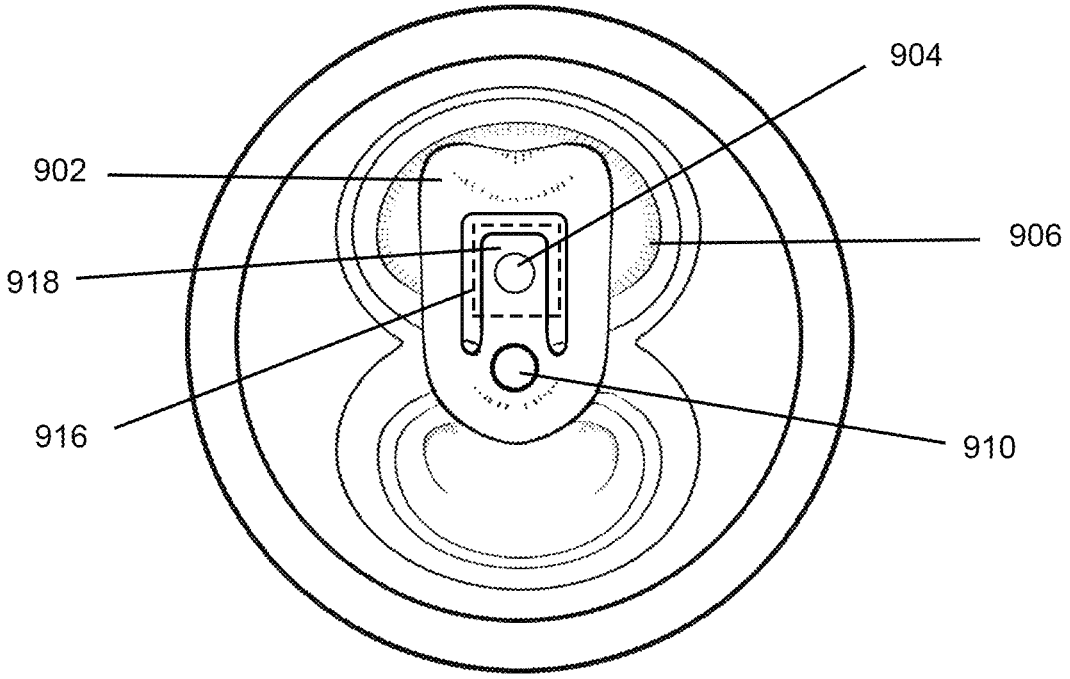
FIG. 9A shows a top view of a can end with an attached tab, closure flap, and rivet in accordance with some embodiments of the disclosed subject matter.
Figure 9B:
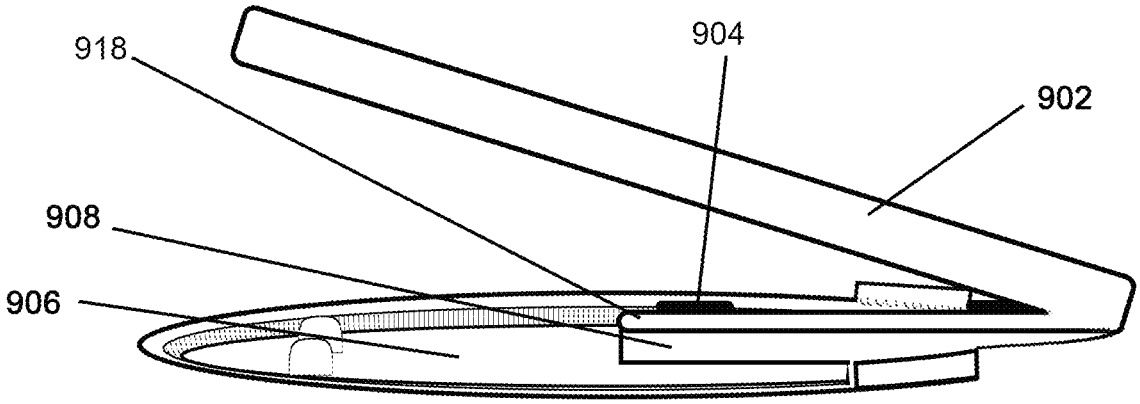
FIG. 9B shows an example view of a closure flap with a closure flap rivet and tab in accordance with some embodiments of the disclosed subject matter.
Figure 9C:
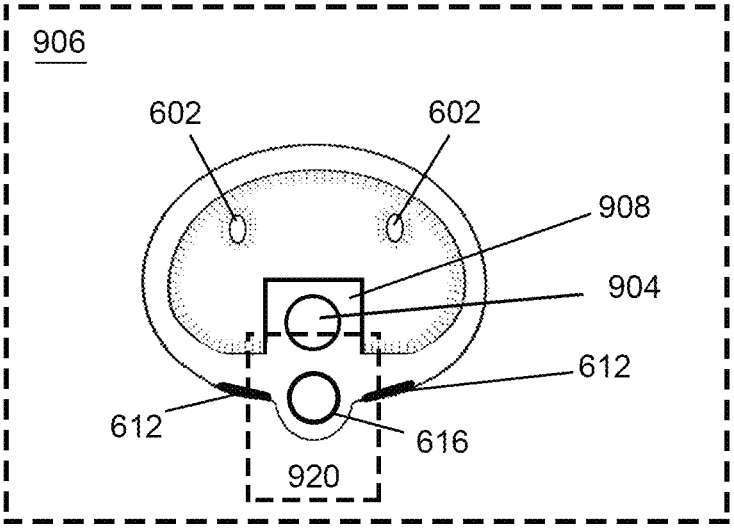
FIGS. 9C and 9D show example views of a closure flap that can connect to a tab and/or lid base rivet in accordance with some embodiments of the disclosed subject matter.

Turning to FIG. 9A, a top view of a tab 902 connected to a closure flap 906 and lid base is shown in accordance with some embodiments of the disclosed subject matter. As illustrated, tab 902 can include a tab rivet area 910, a lip 916, and/or a middle bar 918. Note that FIG. 9F shows a top view of tab 902.

In some embodiments, tab rivet area 910 can correspond to a rivet that is used to couple tab 902 to the lid base. Note that, similar to what is described above, in some embodiments, a rivet used in connection with tab rivet area 910 can be any suitable rivet, such as an independent rivet (e.g., as shown in and described above in connection with FIGS. 4A, 4B, and/or 4C), a rivet that is part of a lid base (e.g., as shown in and described below in connection with FIG. 10), and/or a rivet that is part of tab 902 at a location of tab rivet area 910 (e.g., as shown in and described below in connection with FIG. 3E).

In some embodiments, middle bar 918 can engage with closure flap 906 in any suitable manner. For example, in some embodiments, middle bar 918 can fasten to or otherwise engage with a platform area 908 (e.g., as shown in FIGS. 9B and 9C) of closure flap 906. As another example, in some embodiments, tab opening 318 (as shown in FIG. 3C) can fasten to and/or engage with a closure flap bump 904, as shown in FIGS. 9A and 9B. As yet another example, in some embodiments, middle bar 918 can engage with any suitable independent rivet, such as a rivet 912 shown in FIG. 9E.

Turning to FIG. 9B, a side view of tab 902 and closure flap 906 is shown in accordance with some embodiments of the disclosed subject matter.

Figure 9D:
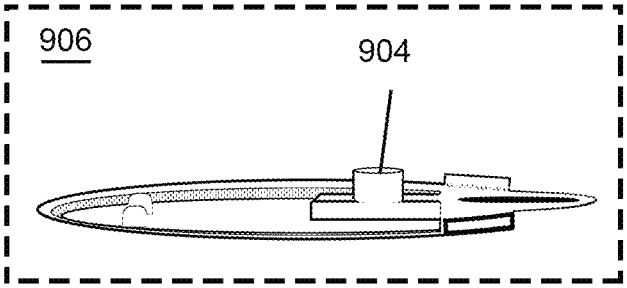
Figure 9E:
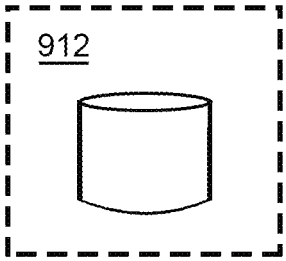
FIG. 9E shows an additional closure flap rivet to connect a pull tab to a closure rivet in accordance with some embodiments of the disclosed subject matter.
Figure 9F:
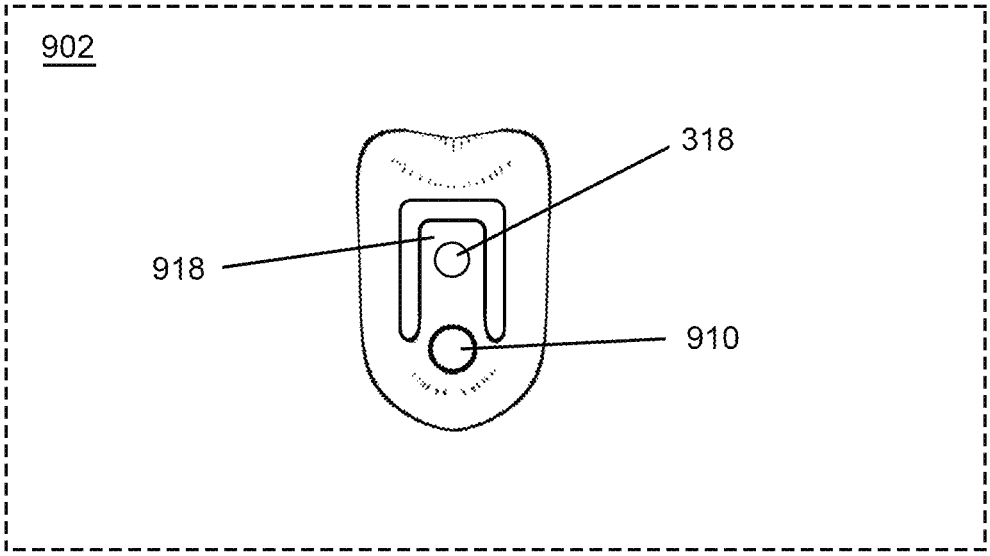
FIG. 9F shows an example view of a tab in accordance with some embodiments of the disclosed subject matter.

Turning to FIGS. 9C and 9D, a top view of closure flap 906 and a side view of closure flap 906, respectively, are shown in accordance with some embodiments of the disclosed subject matter. As illustrated, closure flap 906 includes a bump 904 on platform area 908. In some embodiments, bump 904 can engage with tab 902 by being inserted through a circular tab opening of tab 902 (e.g., tab opening area 318, as shown in FIG. 9F). Referring back to FIG. 9A, in some embodiments, when bump 904 is inserted into the circular tab opening 318 of tab 902, bump 904 can act as a rivet that couples tab 902 and closure flap 906. For example, in some embodiments, bump 904 can be flattened (e.g., by a machine that applies pressure to bump 904), thereby causing bump 904 to act as a rivet that couples tab 902 and closure flap 906. Note that, in instances in which bump 904 acts as a rivet that couples tab 902 and closure flap 906, bump 904 can couple tab 902 and closure flap 906 such that tab 902 and closure flap 906 rotate together in conjunction, thereby acting as a lock mechanism that can aid in tab 902 rotating closure flap 906. In some embodiments, when bump 904 is flattened, bump 904 can create a lip (e.g., as shown in and described below in connection with FIG. 9G) to keep tab 902 connected to closure flap 906.

Note that, as shown in section 920 of FIG. 9C, in some embodiments, platform area 908 can extend or protrude from an outer edge of the closure flap. In some embodiments, section 920 can increase a distance between rivet area 616 and a depressed pocket area of closure flap 906. In some embodiments, platform 908 can have any suitable dimensions (e.g., length, width, thickness, etc.), and platform 908 can protrude from the outer edge of the closure flap by any suitable amount.

Figure 10A:
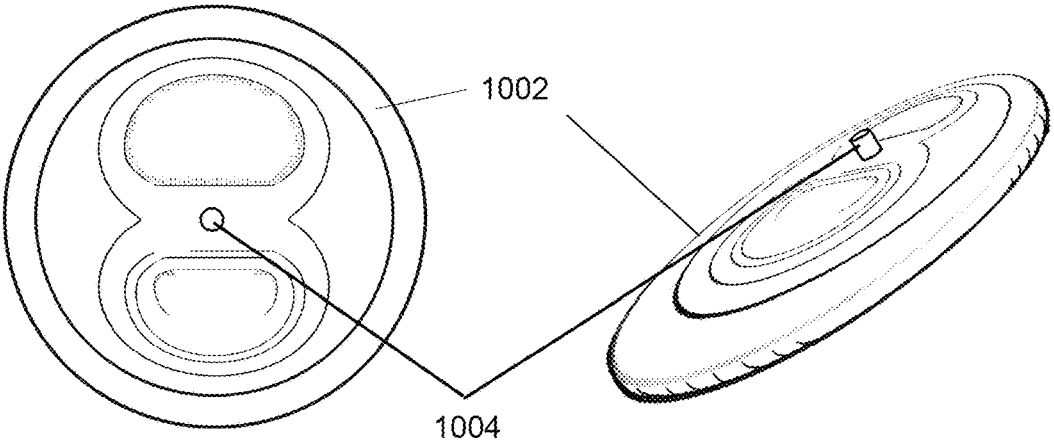
FIGS. 10A, 10B, and 10C show example views of lid bases with different lid base rivet areas in accordance with some embodiments of the disclosed subject matter.
Figure 10B:
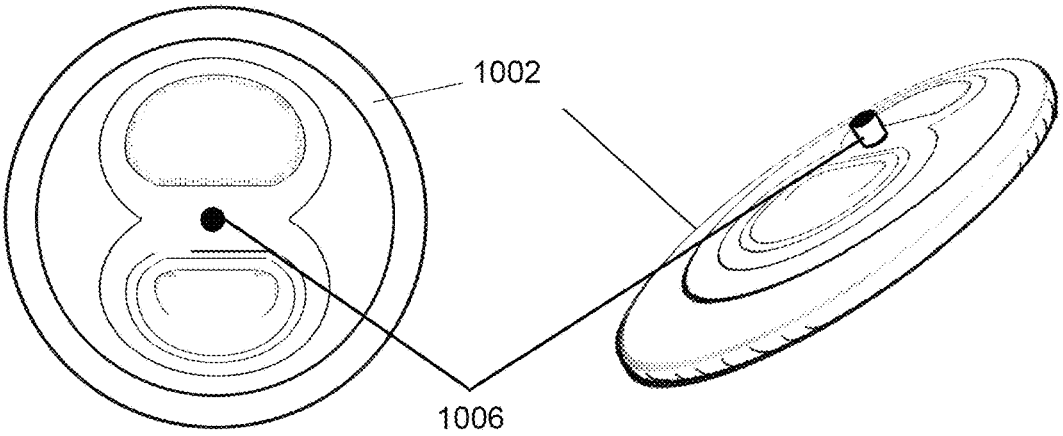
Figure 10C:
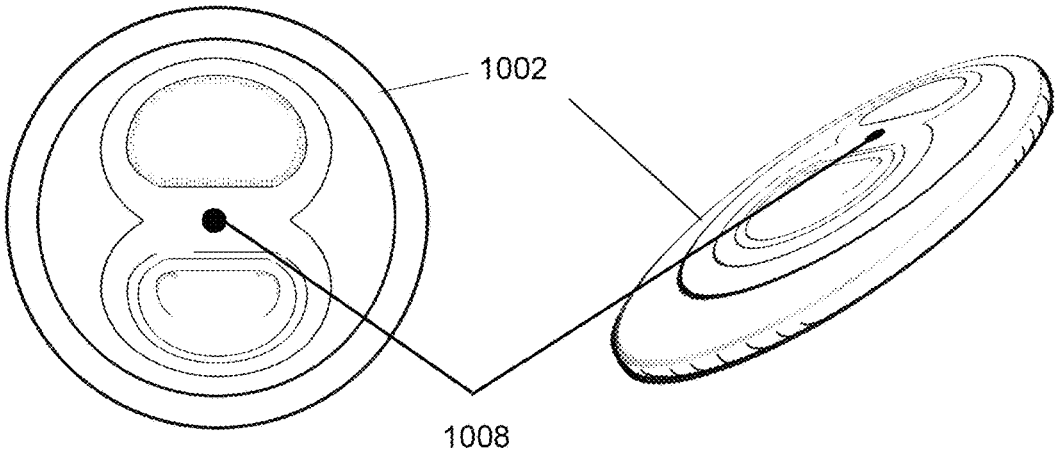

Turning to FIGS. 10A, 10B, and 10C, examples of a lid base 1002 with different lid base rivet area designs are shown in accordance with some embodiments of the disclosed subject matter. Note that, in some embodiments, lid base 1002 can have any suitable outer rim (e.g., an industry-standard can end outer rim, and/or any other suitable outer rim), which can be attached and sealed to a body of a can in any suitable manner (e.g., a double-seam method, and/or in any other suitable manner). Note that, in some embodiments, any suitable tab and/or closure flap can be used in connection with any of the lid bases shown in FIGS. 10A, 10B, and/or 10C.

Referring to FIG. 10A, lid base 1002 can include a protuberance 1004. In some embodiments, protuberance 1004 can be formed on lid base 1002 in any suitable manner. For example, in some embodiments, protuberance 1004 can be formed via any suitable manufacturing technique(s) (e.g., any suitable molding technique, a pulled or pushed force manufacturing technique(s) as part of lid base 1002, welded onto lid base 1002, extruded from lid base 1002, and/or any other suitable technique(s)). In some embodiments, protuberance 1004 can be closed at a top portion of protuberance 1004. In some embodiments, protuberance 1004 can function as a rivet that can couple a closure flap and a tab to lid base 1002. For example, in some embodiments, protuberance 1004 can be inserted through a round shaped closure flap rivet area and through a round shaped tab rivet area. Continuing with this example, in some embodiments, protuberance 1004 can then be flattened in any suitable manner to allow protuberance 1004 to function as a rivet. In some embodiments, protuberance 1004 can be flattened in any suitable manner, such as by a machine that depresses protuberance 1004 and/or applies pressure to protuberance 1004 in any suitable manner.

Turning to FIG. 10B, an example of lid base 1002 with a hollow protuberance 1006 is shown in accordance with some embodiments of the disclosed subject matter. In some embodiments, hollow protuberance 1006 can be formed in any suitable manner. For example, in some embodiments, hollow protuberance 1006 can be formed via any suitable manufacturing technique(s) (e.g., any suitable molding technique, a pulled or pushed force manufacturing technique(s) as part of lid base 1002, welded onto lid base 1002, extruded from lid base 1002, and/or any other suitable technique(s)). In some embodiments, a hollow portion of hollow protuberance 1006 can be formed in any suitable manner. For example, in some embodiments, an adhered protuberance can be drilled, bored, extruded, and/or circular hole punched. In some embodiments, hollow protuberance 1006 can act as a column that can receive any suitable rivet used to couple a tab and a closure flap to lid base 1002. For example, in some embodiments, hollow protuberance 1006 can receive an independent rivet, as shown in and described above in connection with FIGS. 4A, 4B, and/or 4C. As another example, in some embodiments, hollow protuberance 1006 can receive a rivet that is part of a tab, as shown in and described below in connection with FIG. 3E. In some embodiments, a rivet inserted in hollow protuberance 1006 can be sealed or attached from an underside of lid base 1002 in any suitable manner (e.g., as shown in and described below in connection with FIG. 3F). For example, in some embodiments, the rivet can be flattened in any suitable manner, such as by a machine that depresses the rivet and/or applies pressure to the rivet in any suitable manner.

Turning to FIG. 10C, an example of a lid base 1002 with a rivet opening 1008 is shown in accordance with some embodiments of the disclosed subject matter. In some embodiments, rivet opening 1008 can be formed in any suitable manner. For example, in some embodiments, rivet opening 1008 can be formed from any suitable mold, can be circular hole punched in lid base 1002, bored in lid base 1002, drilled through lid base 1002, and/or formed in any other suitable manner. In some embodiments, any suitable rivet can be inserted through rivet opening 1008 to couple a tab and a closure flap to lid base 1002. For example, in some embodiments, rivet opening 1008 can receive an independent rivet, as shown in and described above in connection with FIGS. 4A, 4B, and/or 4C. As another example, in some embodiments, rivet opening 1008 can receive a rivet that is part of a tab, as shown in and described below in connection with FIG. 3E.

Figure 3E:
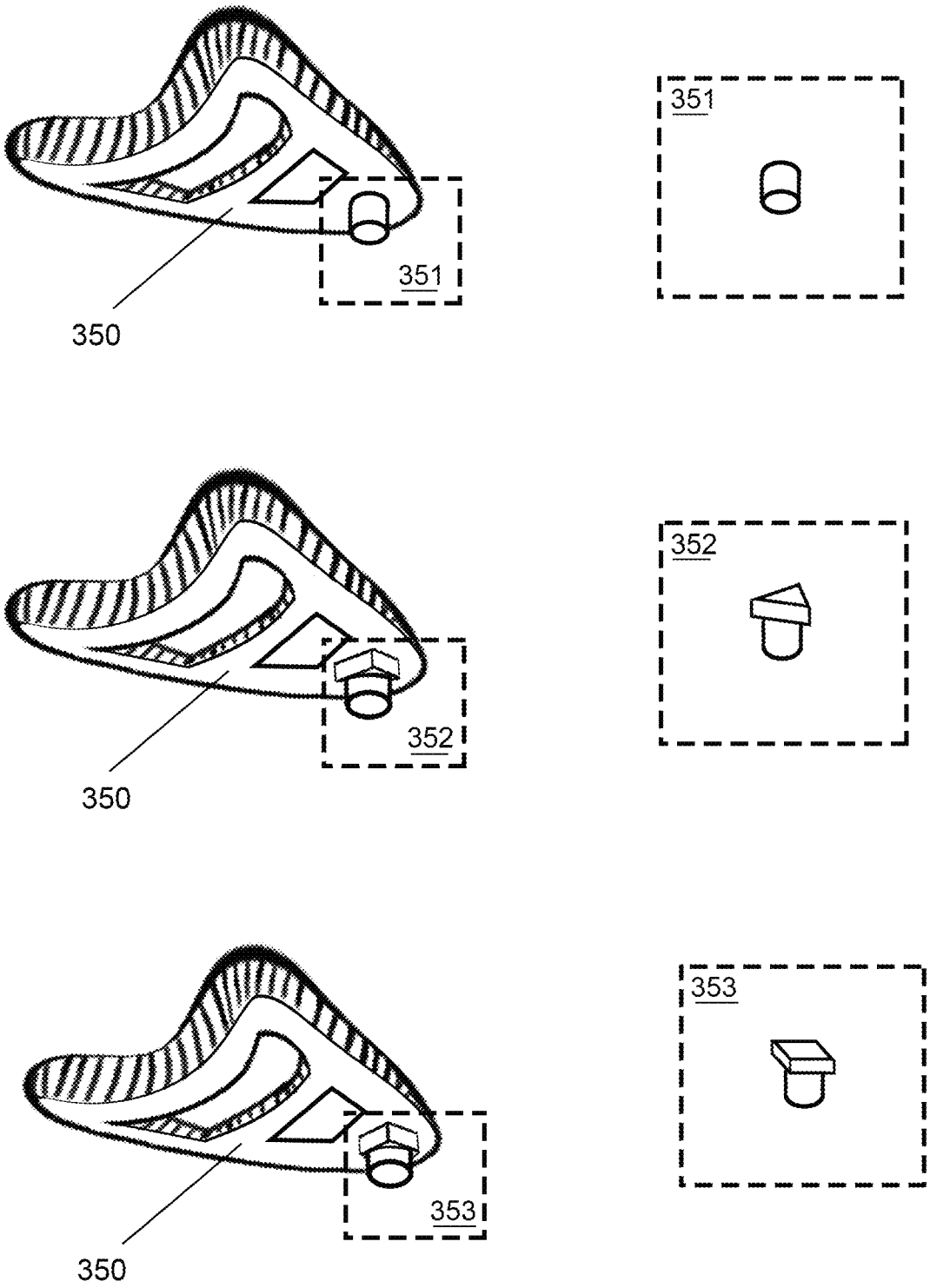
FIG. 3E show views of a tab that has a rivet portion in accordance with some embodiments of the disclosed subject matter.

Turning to FIG. 3E, examples of rivets that are part of a tab are shown in accordance with some embodiments of the disclosed subject matter. As illustrated, FIG. 3E shows different designs for rivets that can be attached to or are otherwise part of a tab 350. Note that, in some embodiments, tab 350 can be used in connection with any suitable closure flap and/or any suitable lid base that can receive a rivet that is part of tab 350. Additionally, note that, in some embodiments, a rivet that is part of tab 350 can be formed in any suitable manner. For example, in some embodiments, a rivet can be adhered to tab 350 (e.g., welded to tab 350, pulled or pushed force or other suitable manufacturing technique as part of tab 350, and/or adhered in any other suitable manner), formed via any suitable mold, extruded, and/or formed in any other suitable manner.

In some embodiments, a rivet that is a part of tab 350 can be any suitable shape, and can include any suitable sections, each having any suitable shape. For example, in some embodiments, tab 350 can include a rivet 351 that has a circular shape. As another example, in some embodiments, tab 350 can include a rivet 352 that can include a triangular section that can act as a lock above a circular portion of rivet 352. As yet another example, in some embodiments, tab 350 can include a rivet 353 that includes a square section that can act as a lock above a circular portion of rivet 353.

In some embodiments, a circular portion of a rivet that is part of tab 350 can be inserted through a circular closure flap rivet area (e.g., circular closure flap rivet area 616, as shown in FIG. 6A, and/or any other suitable circular closure flap rivet area) and then through a circular lid base rivet area (e.g., lid base rivet area 204 as shown in FIG. 2B, hollow protuberance 1006 as shown in FIG. 10B, rivet opening 1008 as shown in FIG. 10C, and/or any other suitable circular lid base rivet area).

Figure 3F:
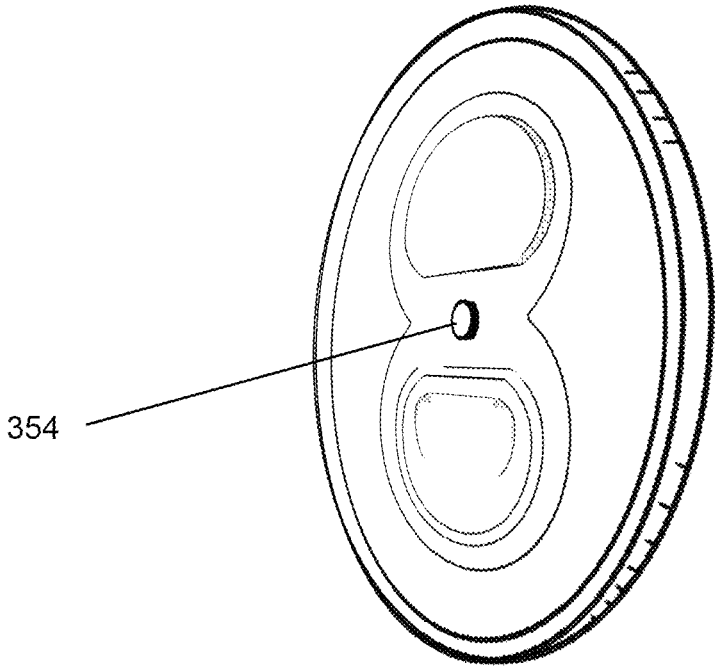
FIG. 3F shows an underside of a lid base with an attached rivet in accordance with some embodiments of the disclosed subject matter.

In some embodiments, a rivet can then be attached to the connected lid base, closure flap, and tab in any suitable manner. For example, in some embodiments, the rivet can be flattened in any suitable manner, such as by a machine that depresses the rivet from an underside of the lid base after the rivet is inserted through the lid base rivet area. Turning to FIG. 3F, an underside of a lid base after a rivet is inserted and flattened is shown in accordance with some embodiments of the disclosed subject matter. As illustrated, FIG. 3F includes a flattened rivet 354 that has been flattened by any suitable machine that applies pressure to the rivet after insertion through the lid base rivet area.

Figure 9G:
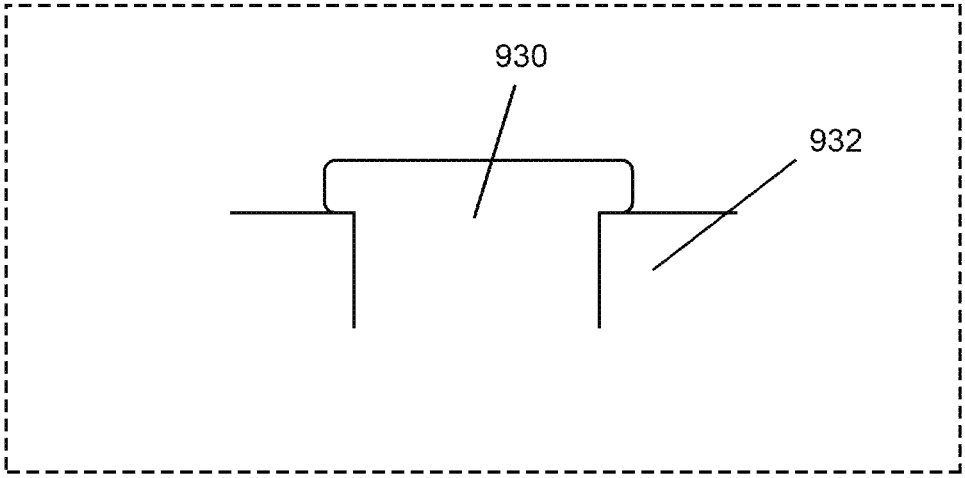
FIG. 9G shows a cross-sectional view of a flattened rivet in accordance with some embodiments of the disclosed subject matter.

Turning to FIG. 9G, an example cross-sectional view of a machine flattened rivet is shown in accordance with some embodiments of the disclosed subject matter. As illustrated, FIG. 9G includes a flattened rivet 930, and a side portion 932. In some embodiments, flattened rivet 930 can correspond to any suitable rivet that is created using any suitable technique(s), as described above. Note that, in some embodiments, flattened rivet 930 can correspond to an independent rivet, a rivet that is part of a tab, a rivet that is part of a lid base, and/or any other suitable rivet. For example, in some embodiments, flattened rivet 930 can correspond to an independent rivet as shown in and described above in connection with FIGS. 4A, 4B, and/or 4C. As another example, in some embodiments, flattened rivet 930 can correspond to a rivet that is part of a tab as shown in and described above in connection with FIG. 3E and/or a rivet that is part of a lid base as shown in and described above in connection with FIG. 10A or 10B.

In some embodiments, side portion 932 can correspond to any suitable surface on which a lip of flattened rivet 930, once flattened, is positioned. For example, in an instance in which flattened rivet 930 corresponds to a rivet that is part of a tab or an independent rivet that is inserted through a tab, closure flap, and lid base, side portion 932 can correspond to a lid base, where flattened rivet 930 is flattened on an underside of the lid base. As another example, in an instance in which flattened rivet 930 corresponds to a rivet that is part of a lid base, side portion 932 can correspond to a tab, where flattened rivet 930 is flattened from above a tab.

Accordingly, reclosable can ends are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A reclosable can end, comprising:

a lid base positioned at a top portion of the reclosable can end, wherein the lid base comprises a scored area;

a tab, wherein a first end of the tab is configured to apply pressure to the scored area of the lid base when a second end of the tab, opposite the first end of the tab, is lifted and causes the scored area to at least partially separate from the lid base to expose an opening in the lid base;

a closure flap, wherein the closure flap comprises:

a first portion that has dimensions corresponding to dimensions of the opening in the lid base opening wherein the first portion of the closure flap includes a raised bump that connects with a portion of the tab;

a second portion that comprises an outer edge that extends beyond the first portion of the closure flap;

an opening; and a protruding portion that protrudes from the outer edge of the second portion of the closure flap; and a rivet that connects the tab and the closure flap to the lid base such that the tab and the closure flap are configured to rotate around the rivet, wherein the rivet connects the tab and the closure flap to the lid base via the opening in the closure flap, wherein the first portion of the closure flap is configured to be inserted into the opening in the lid base end when the tab and the closure flap are rotated to a position corresponding to a position of the opening in the lid base, wherein the outer edge of the second portion of the closure flap is positioned on the top portion of the lid base when the first portion of the closure flap is inserted into the opening in the lid base, wherein an edge that connects the first portion of the closure flap to the outer edge of the second portion of the closure flap includes an angled portion that connects to an indented portion such that the indented portion is positioned on a bottom portion of the lid base opening edge when the first portion of the closure flap is inserted into the opening of the lid base, and wherein a side portion of the closure flap includes a lip, wherein the tab includes a lip, and wherein the lip of the closure flap meets the lip of the tab.

2. The reclosable can end of claim 1, wherein the lid base comprises a lid base pocket that has dimensions that correspond to the dimensions of the first portion of the closure flap.

3. The reclosable can end of claim 2, wherein the lid base comprises a depressed slide area formed from the lid base pocket to the opening in the lid base.

4. The reclosable can end of claim 1, wherein a bottom portion of the first portion of the closure flap includes a coating of sealant.

5. The reclosable can end of claim 4, wherein the coating of sealant comprises a plurality of layers of sealant.

6. The reclosable can end of claim 4, wherein the coating of sealant comprises a material that is harmless to consumers.

7. The reclosable can end of claim 1, wherein the second end of the tab is concave such that the second end curves toward the first end.

8. The reclosable can end of claim 1, wherein the raised bump of the closure flap is inserted through a hole in the tab.

9. The reclosable can end of claim 1, wherein the outer edge of the second portion of the closure flap is flat.

10. The reclosable can end of claim 1, wherein the outer edge of the second portion of the closure flap is angled upward away from the first portion of the closure flap.

11. The reclosable can end of claim 1, wherein the outer edge of the second portion of the closure flap has an arched shape that bends away from the first portion of the closure flap.

12. The reclosable can end of claim 1, wherein the outer edge of the second portion of the closure flap has an arched shape that bends towards the first portion of the closure flap.

13. The reclosable can end of claim 1, wherein the outer edge of the second portion of the closure flap has an arched shape.

14. The reclosable can end of claim 1, wherein the rivet is formed as part of the top portion of the lid base.

15. The reclosable can end of claim 1, wherein the rivet is formed as part of the tab.

16. The reclosable can end of claim 1, wherein the rivet is not formed from any of the lid base, tab, and closure flap.

17. The reclosable can end of claim 1, wherein the lid base comprises a drip catch.

18. A reclosable can end, comprising:

a lid base positioned at a top portion of the reclosable can end, wherein the lid base comprises a scored area;

a tab, wherein a first end of the tab is configured to apply pressure to the scored area of the lid base when a second end of the tab, opposite the first end of the tab, is lifted and causes the scored area to at least partially separate from the lid base to expose an opening in the lid base;

a closure flap, wherein the closure flap comprises:

a first portion that has dimensions corresponding to dimensions of the opening in the lid base opening wherein the first portion of the closure flap includes a raised bump that connects with a portion of the tab;

a second portion that comprises an outer edge that extends beyond the first portion of the closure flap;

an opening; and a protruding portion that protrudes from the outer edge of the second portion of the closure flap; and a rivet that connects the tab and the closure flap to the lid base such that the tab and the closure flap are configured to rotate around the rivet, wherein the rivet connects the tab and the closure flap to the lid base via the opening in the closure flap, wherein the first portion of the closure flap is configured to be inserted into the opening in the lid base end when the tab and the closure flap are rotated to a position corresponding to a position of the opening in the lid base, wherein the outer edge of the second portion of the closure flap is positioned on the top portion of the lid base when the first portion of the closure flap is inserted into the opening in the lid base, wherein an edge that connects the first portion of the closure flap to the outer edge of the second portion of the closure flap includes an angled portion that connects to an indented portion such that the indented portion is positioned on a bottom portion of the lid base opening edge when the first portion of the closure flap is inserted into the opening of the lid base, and wherein the lid base comprises a push button that is positioned to serve as a stop against movement of the closure flap and the tab, but may be selectively depressed to permit movement of the closure flap and the tab.

19. The reclosable can end of claim 18, wherein the lid base comprises a lid base pocket that has dimensions that correspond to the dimensions of the first portion of the closure flap.

20. The reclosable can end of claim 19, wherein the lid base comprises a depressed slide area formed from the lid base pocket to the opening in the lid base.

* * * * *